US006496164B1

(12) United States Patent
Kuwahara et al.

(10) Patent No.: US 6,496,164 B1
(45) Date of Patent: Dec. 17, 2002

(54) PLASMA DISPLAY DEVICE AND METHOD OF DRIVING PLASMA DISPLAY PANEL, HAVING FIRST AND SECOND REPRESENTING UNITS

(75) Inventors: Takeshi Kuwahara, Kawasaki (JP); Yoshikazu Kanazawa, Kawasaki (JP); Toshio Ueda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/313,377

(22) Filed: May 18, 1999

(30) Foreign Application Priority Data

May 18, 1998 (JP) ..... 10-135398
Apr. 27, 1999 (JP) ..... 11-120226

(51) Int. Cl.[7] ..... G09G 3/28
(52) U.S. Cl. ..... 345/60; 315/169.4
(58) Field of Search ..... 345/60–72; 348/797; 315/169.1–169.4

(56) References Cited

U.S. PATENT DOCUMENTS 5,436,634 A * 7/1995 Kanazawa ..... 345/67
6,100,859 A 8/2000 Kuriyama et al.
6,104,362 A 8/2000 Kuriyama et al.
6,169,527 B1 * 1/2001 Kanazawa ..... 345/60

FOREIGN PATENT DOCUMENTS

EP 0 762 373 3/1997
JP 04366885 A * 12/1992 ..... G09G/1/00
JP 7-261699 10/1995
JP 9-160525 6/1997
JP 11282447 A * 10/1999 ..... G09G/5/14
KR 97-17861 4/1997

OTHER PUBLICATIONS

"Flicker Reduction Method and Apparatus for Plasma Displays", IBM TDB, vol. 28. Issue 1, pp. 298–300.*

* cited by examiner

*Primary Examiner*—Richard Hjerpe
*Assistant Examiner*—Alexander Eisen
(74) *Attorney, Agent, or Firm*—Staas & Halsey LLP

(57) ABSTRACT

A plasma display device has a first representing unit, a second representing unit, a judging unit, and a selector. The first representing unit lights only one of even display lines and odd display lines which represent one frame, and the second representing unit lights only the other one of the even display lines and the odd display lines. The judging unit judges a condition for an image to be displayed, and the selector selects whichever of the first representing unit and the second representing unit is used to display an image, based on the results of judgment made by the judging unit. Consequently, the service lives of phosphors and a protecting film can be extended and sticking in a screen can be prevented.

24 Claims, 29 Drawing Sheets

A···ADDRESSING DISCHARGE
E···WHOLE-SURFACE SELF-ERASING DISCHARGE
S···SUSTAINING DISCHARGE
W···WHOLE-SURFACE WRITING DISCHARGE

PLASMA DISPLAY DEVICE AND METHOD OF DRIVING PLASMA DISPLAY PANEL, HAVING FIRST AND SECOND REPRESENTING UNITS

BACKGROUND OF THE INVENTION

1. Field of the Invention

The present invention relates to a plasma display device and a method of driving a plasma display panel, and more particularly to a surface discharge alternating current driving type (surface discharge AC type) plasma display device and a method of driving a surface discharge AC type plasma display panel, having first and second representing units.

2. Description of the Related Art

Recently, a plasma display device has been practically adopted as a display device and adapted to various apparatuses and systems. A plasma display panel (PDP) is of a self-glowing type and can therefore display images in a well discernible manner. Moreover, the plasma display panel can offer a thin large screen and achieve fast display. The PDP is therefore attracting attention as a display panel taking over the CRT. In particular, a surface discharge AC type PDP is suitable for full-color display and therefore promising in the field of high-quality television. The surface discharge AC type PDP is highly requested to offer high image quality.

An approach to high-quality display images is to attain high definition, high-level gray scale, high luminance, low luminance for black display, or high contrast. High definition is attained by narrowing a pitch between pixels. High-level gray scale is attained by increasing the number of sub-frames (sub-fields) within a frame (field). High luminance is attained by increasing the number of times of sustaining discharge. Moreover, low luminance for black display is attained by minimizing an amount of glow to be emitted during a reset period. A PDP (surface discharge AC type PDP) is demanded to extend the service lives of phosphors and a protecting film and prevent sticking in a screen so as to prevent deterioration of quality of display images. There is also an increasing demand for a plasma display device and a method of driving a plasma display panel in which even when the same steady image is displayed for a long period, ordinary images will not be affected by sticking stemming from the steady image.

Incidentally, a plasma display device is used as display devices for various types of equipment, e.g., an automatic teller machine (ATM) to be installed at banks. In this case, a specified screen is kept displayed until a user (customer) uses the ATM. Even when the plasma display device is used as display devices for other various apparatuses, a specified steady screen may often have to be displayed continuously. When a specified screen is displayed continuously for a prolonged period of time, phosphors and a protecting film that are components of a PDP may deteriorate. Otherwise, sticking of the specified screen occurs in a screen.

Moreover, assume that an input picture is an ordinary-definition television picture consisting of 512 progressive scanning lines and conforming to the NTSC, PAL, or SECAM. In this case, it is unnecessary to switch the display lines. The parity signal is therefore not switched from one to the other. The same display lines remain lit. Assume that the same display lines are continuously lit, and that the display lines being lit are compared with those not lit. A difference in glowing efficiency of phosphors is larger than that observed when the display lines are alternately selected. Assume that the glowing efficiency of the phosphors on the display lines being lit is compared with that on the display lines not lit. In this case, the glowing efficiency of the phosphors on the display lines being lit is much poorer. This may cause shading in the direction of the lines.

Prior arts and the problems thereof will be explained later in connection with drawings.

SUMMARY OF THE INVENTION

An object of the present invention is to provide a plasma display device for distinguishing a steady image causing sticking from the other ordinary images by discriminating a representation by odd display lines from a representation by even display lines. In the plasma display device, sticking in a screen in which an ordinary image is displayed is indiscernible. Another object of the present invention is to provide a plasma display device capable of ensuring the extended service lives of phosphors and a protecting film and preventing sticking in a screen.

According to the present invention, there is provided a plasma display device including a first representing unit for lighting only one of even display lines and odd display lines which represent one frame, and a second representing unit for lighting only the other one of the even display lines and the odd display lines, comprising a judging unit for judging a condition for an image to be displayed; and a selector for selecting whichever of the first representing unit and the second representing unit is used to display an image, based on the results of judgment made by the judging unit.

When an image to be displayed is a steady image, the judging unit may use the first representing unit to display the image; and when an image to be displayed is any image other than the steady image, the judging unit may use the second representing unit to display the image. The steady image may be an initial operation image persisting until a predetermined operation is carried out, and images other than the steady image may be a plurality of images designated using the initial operation image. The judging unit may include a display time integrating unit for calculating a display time required by the image to be displayed by integrating time intervals during which the image is displayed, and the judging unit may switch an image display using the first representing unit and an image display using the second representing unit, based on the display time required by the image which is calculated by the display time integrating unit.

The judging unit may include an image comparing unit for detecting a change of the image to be displayed to another, and the judging unit may switch a first representation and a second representation, according to the detected change of the image. The comparing unit may compare the image to be displayed with an image stored in advance in a comparison image storage unit; when the image to be displayed agrees with the image stored in the comparison image storage unit, the first representing unit may be used to represent the image; and when the image to be displayed disagrees with the image stored in the comparison image storage unit, the second representing unit may be used to represent the image. After the image to be displayed is changed to another, if the steady image persists over a predetermined number of frames, the comparing unit may switch the first representation and the second representation.

The image display using the first representing unit and the image display using the second representing unit may be switched in response to an externally supplied switching signal. A first image may be displayed using both the first representing unit and second representing unit, and a second image may be displayed using one of the first representing unit and second representing unit. The first image may be a high-definition television picture, and the second image may be an ordinary-definition television picture. The plasma display device may light one of two display lines lying on and under each scan electrode, and may selectively light only the even display lines or the odd display lines.

Further, according to the present invention, there is provided a plasma display device including a first representing unit for lighting only one of even display lines and odd display lines which represent one frame, and a second representing unit for lighting only the other one of the even display lines and the odd display lines, wherein the first representing unit and the second representing unit represent mutually independent images.

According to the present invention, there is also provided a method of driving a plasma display panel that provides a first representation by lighting one of even display lines and odd display lines and a second representation by lighting the other one of the even display lines and the odd display lines, comprising the steps of judging a condition for an image to be displayed; and selecting whichever of the first representation and the second representation is used to display an image, based on results of the judgment.

When the image to be displayed is a steady image, the image may be displayed using the first representation; and when the image to be displayed is any image other than the steady image, the image may be displayed using the second representation. The steady image may be an initial operation image persisting until a predetermined operation is carried out, and the images other than the steady image may be a plurality of images to be designated using the initial operation image. A display time required by the image to be displayed may be calculated by integrating time intervals during which the image to be displayed is displayed, and the first representation and the second representation may be switched, based on the calculated display time. A change of the image to be displayed to another may be detected, and the first representation and second representation may be switched based on the detected change of the image to be displayed.

The image to be displayed may be compared with an image stored in advance in a comparison image storage unit; when the image to be displayed agrees with the image stored in the comparison image storage unit, the image may be displayed using the first representation; and when the image to be displayed disagrees with the image stored in the comparison image storage unit, the image may be displayed using the second representation. After the image to be displayed is changed to another, when a steady image persists over a predetermined number of frames, the first representation and the second representation may be switched.

The first representation and the second representation may be switched in response to an externally supplied switching signal. A first image may be displayed using both of the first representation and the second representation, and a second image may be displayed using one of the first representation and the second representation. The first image may be a high-definition television picture and the second image may be an ordinary-definition television picture. The plasma display panel may light one or the other of two display lines lying on and under each scan electrode, and may selectively light only the even display lines or the odd display lines.

Further, according to the present invention, there is also provided a method of driving a plasma display panel that provides a first representation by lighting one of even display lines and odd display lines that represent one frame, and a second representation by lighting the other one of the even display lines and the odd display lines, wherein the first representation and the second representation are used to display mutually independent images.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

To begin with, a related art and underlying problems will be described with reference to the appended drawings. Thereafter, a description will be made of embodiments of plasma display devices and methods of driving a plasma display panel in accordance with the present invention.

Figure 1:
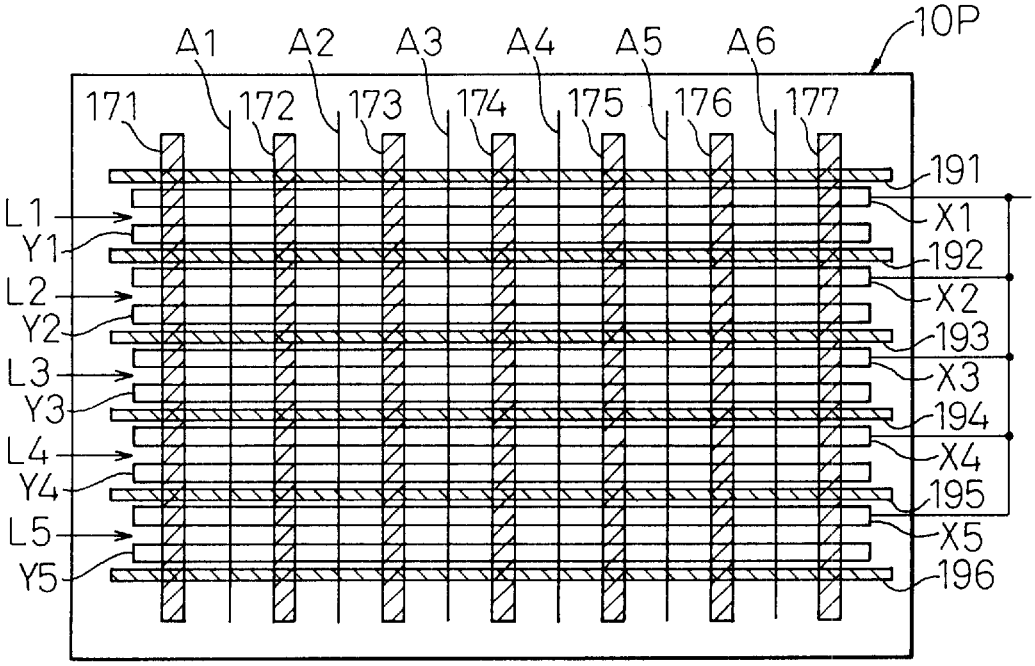
Fig. 1 (PRIOR ART)
FIG. 1 schematically shows an example of conventional surface discharge AC type PDPS.
Figure 2:
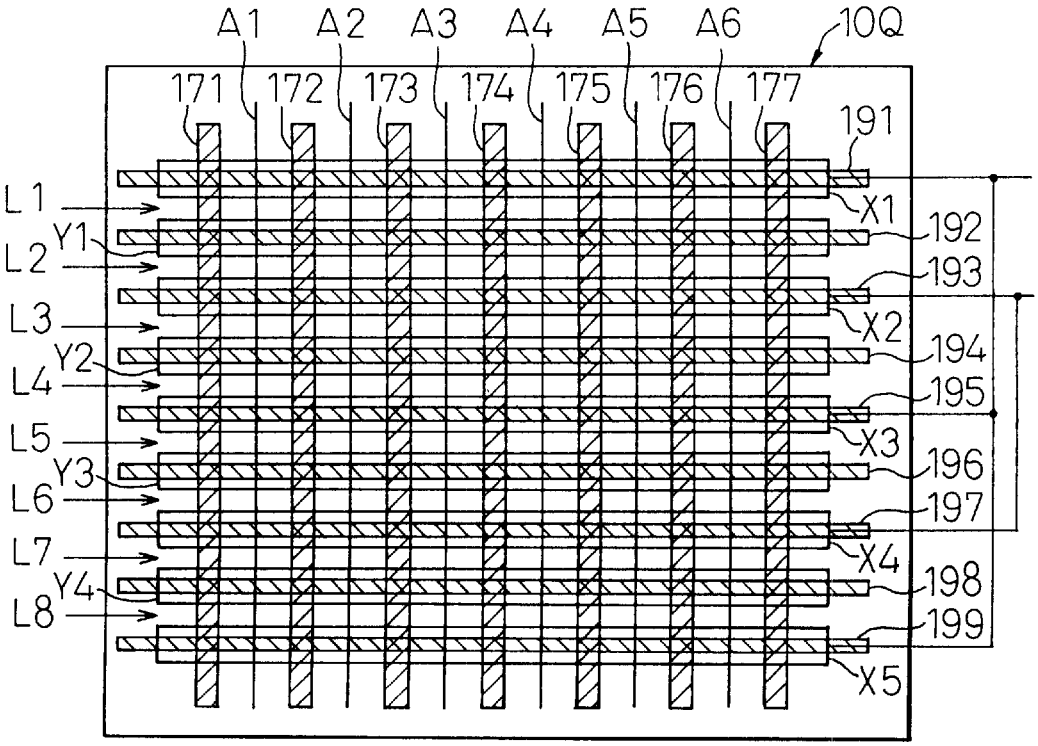
Fig.2 (PRIOR ART)
FIG. 2 schematically shows another example of conventional surface discharge AC type PDPS.

FIG. 1 schematically shows an example of conventional surface discharge AC type plasma display panel (PDP), and FIG. 2 schematically shows another example of conventional surface discharge AC type PDPs. Reference numerals 10P and 10Q denote PDPs.

Referring to FIG. 1, the PDP 10P has glass substrates opposed to each other. One of the glass substrates (on the side of an observer) has electrodes X1 to X5 juxtaposed with an equal pitch between adjoining electrodes. Electrodes Y1 to Y5 are juxtaposed while paired with the electrodes X1 to X5. The other glass substrate has address electrodes A1 to A6 juxtaposed in a direction orthogonal to the direction of the electrodes X1 to X5 and Y1 to Y5. Phosphors are coated over the address electrodes. Barriers 171 to 177 and barriers 191 to 196 are arranged to cross one another in the form of a lattice in a space between the opposed glass substrates. The inclusion of the barriers is intended to prevent incorrect display stemming from influence of discharge of any pixel location upon adjoining pixel locations.

As far as the surface discharge PDP is concerned, discharge occurs between adjoining electrodes on the same plane (between X and Y electrodes). This is advantageous because it can be prevented that ions collide with the phosphors formed on the opposite surface to deteriorate the phosphors. However, since a pair of electrodes lies along each of display lines L1 to L5, narrowing a pitch between adjoining pixels is limited to hinder high-definition display. Furthermore, the number of electrodes is so large that the scale of a drive circuit expands.

The PDP 10Q shown in FIG. 2 has been proposed in the past (Japanese Unexamined Patent Publication (Kokai) Nos. 5-2993 and 2-220330).

Referring to FIG. 2, barriers 191 to 199 are juxtaposed along the center lines of electrodes X1 to X5 and Y1 to Y5, which are surface discharge electrodes, in the PDP 10Q. The electrodes X2 to X4 and electrodes Y1 to Y4 except the outermost electrodes X1 and X5 are shared by adjoining display lines in the direction of the address electrodes. Consequently, the number of electrodes lying in the direction of rows (X electrodes and Y electrodes) can be nearly halved, and a pitch between adjoining pixels can be narrowed. Higher-definition display can be achieved than that achieved by the PDP 10P shown in FIG. 1. At the same time, the PDP 10Q shown in FIG. 2 makes it possible to scale down a drive circuit owing to the decreased number of electrodes.

However, in the PDP 10Q shown in FIG. 2, the display lines L1 to L8 are written line-sequentially. Unless the barriers 191 to 199 are present, pixel locations adjoining in the direction of the address electrodes are affected by discharge and displayed incorrectly. The barriers 191 to 199 cannot therefore be removed. This hinders high-definition display deriving from a diminished pitch between adjoining pixels. Moreover, it is not easy to lay down the barriers 191 to 199 along the center lines of the electrodes (X electrodes and Y electrodes). This makes the PDP 10Q expensive. For removing the barriers lying in the direction of the surface discharge electrodes, the spacing between electrodes located on both sides of each of the barriers 191 to 196 must be widened in order to minimize electric-field intensity. This leads to an increase in the pitch between adjoining pixels. Consequently, high-definition display is hindered. For example, when the spacing between electrodes X1 and Y1 is 50 $\mu$m, the spacing between electrodes Y1 and X2 must be 300 $\mu$m.

Moreover, discharge and glow occur over the whole surface of the PDP during a reset period. This causes the luminance for black display to rise and display quality to deteriorate. Moreover, since the phosphors are white or light gray, when an image on the PDP is seen in a bright place, the contrast of the image is poor. This is because extraneous light is reflected from the phosphors lying on non-representation display lines. Furthermore, in the PDPs 10P and 10Q shown in FIG. 1 and FIG. 2, only one display line can be addressed at a time. The addressing period cannot therefore be shortened. This hinders higher-level gray-scale display deriving from an increased number of sub-fields or higher luminance display deriving from an increased number of times of sustaining discharge.

Figure 3:
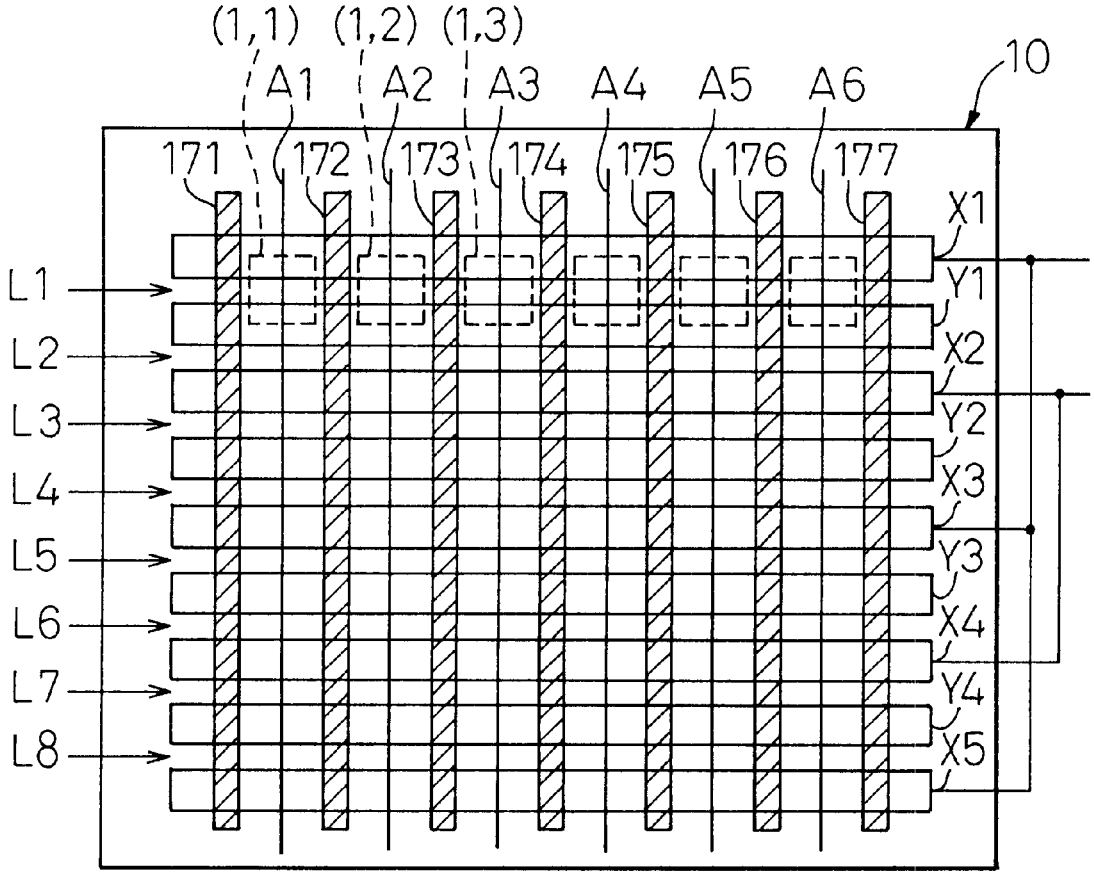
Fig.3 (PRIOR ART)
FIG. 3 schematically shows still another example of conventional surface discharge AC type PDPS.

FIG. 3 schematically shows still another example of conventional surface discharge ac-type PDPs (Refer to Japanese Unexamined Patent Publication No. 9-160525). The present invention is implemented in a PDP 10 (ALIS type PDP) like the one shown in FIG. 3. For example, depending on how a driving signal (display data) is processed, the present invention can be implemented in the PDP 10P or 10Q shown in FIG. 1 or FIG. 2 alike.

In FIG. 3 showing the PDP, pixel locations lying along a display line Li are indicated with dashed lines. For brevity's sake, the number of pixels offered by the PDP 10 is 6×8=48 for monochrome display. The present invention can be implemented in either of color and monochrome PDPs. A single pixel of a color display corresponds to three pixels of a monochrome display.

The PDP 10 shown in FIG. 3 is realized by removing the barriers 191 to 199 from the PDP 10Q shown in FIG. 2. This is intended to simplify manufacturing, diminish the pitch between adjoining pixels, and thus achieve high-definition display. Interlaced scanning is adopted in an effort to prevent incorrect discharge stemming from interaction between adjoining display lines which is derived from the removal of barriers. Interlaced scanning is carried out so that a sustaining pulsating voltage will exhibit opposite phases between odd and even display lines L1 to L8 among the surface discharge electrodes. For example, in interlaced scanning in the PDP shown in FIG. 2, the display lines L2, L4, and L6 are fully non-representation display lines. The display lines L1 and L5 are scanned during an odd field, and the display lines L3 and L7 are scanned during an even field.

Figure 4:
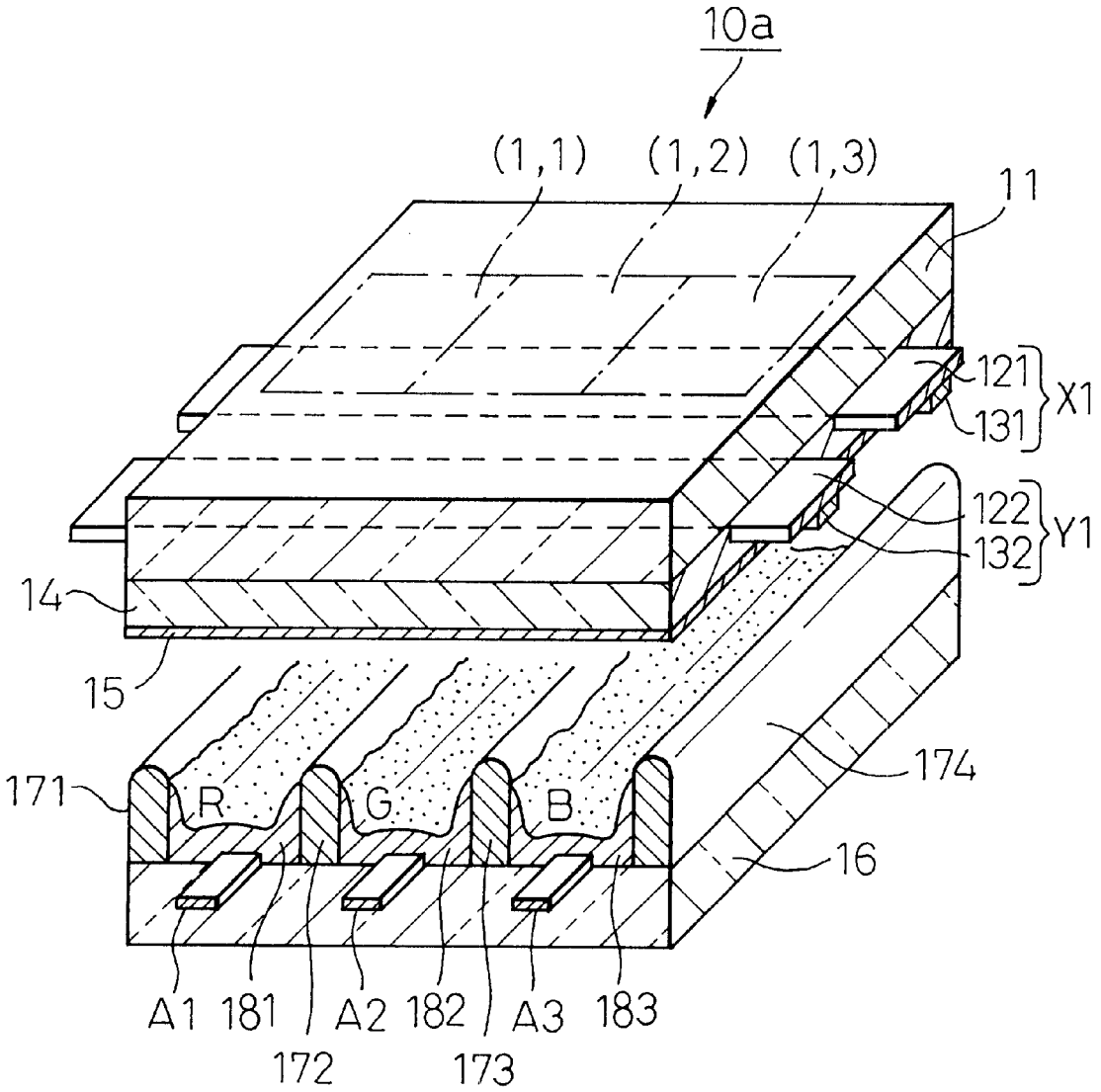
Fig.4 (PRIOR ART)
FIG. 4 is a perspective view showing opposed substrates with a gap between them widened for explaining the structure of a color pixel location in the PDP shown in FIG. 3.
Figure 5:
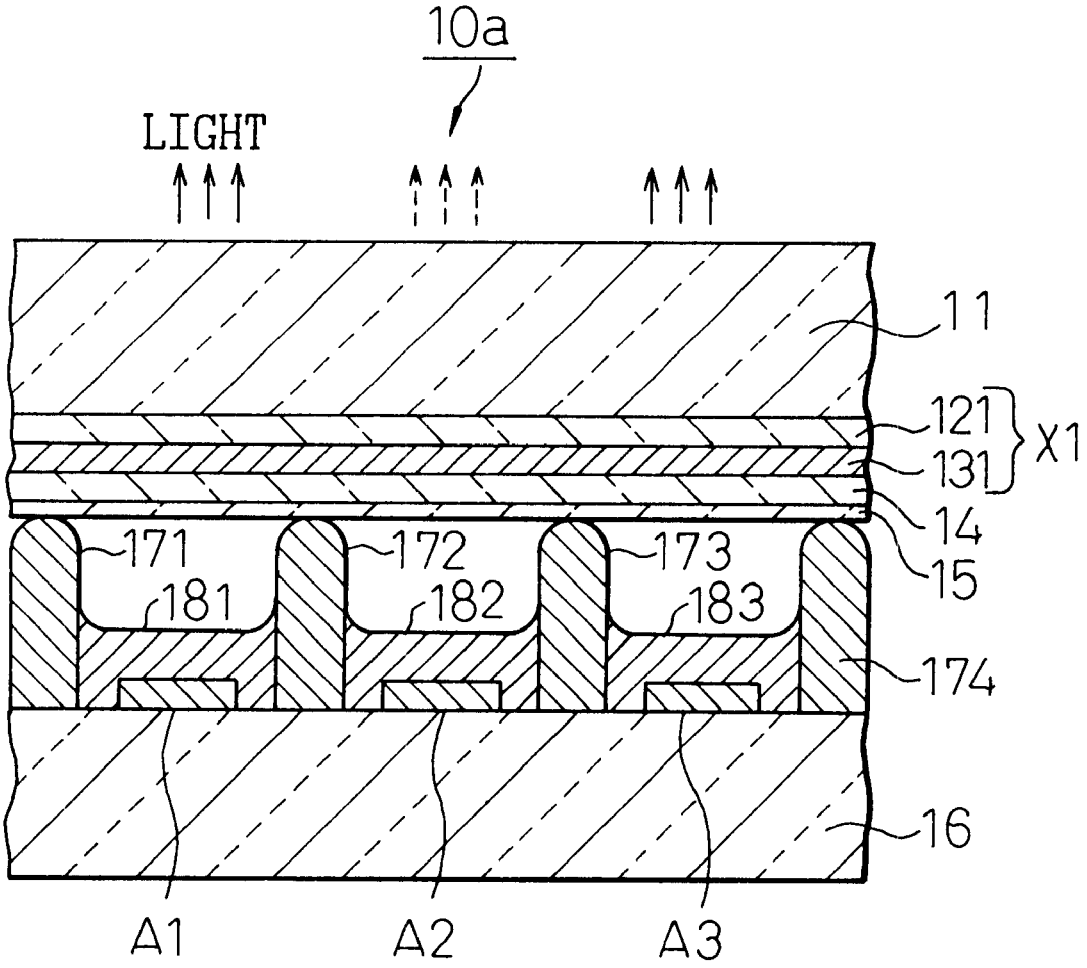
FIG. 5 is a sectional view showing a color pixel location in the PDP shown in FIG. 3 on a cutting plane along an electrode X1.

FIG. 4 is a perspective view showing the structure of a color pixel 10*a* in the PDP shown in FIG. 3, wherein the spacing between the opposed substrates is widened. FIG. 5 is a sectional view showing the color pixel 10*a* in the PDP in FIG. 3 on a cutting plane along the electrode X1.

AS shown in FIG. 4 and FIG. 5, transparent electrodes 121 and 122 realized with indium-tin-oxide (ITO) films or the like are placed parallel to one another over the surface of the glass substrate 11. Metallic electrodes 131 and 132 made of copper or the like and intended to minimize a voltage drop are formed along the center lines of the transparent electrodes 121 and 122 in the longitudinal direction thereof. The transparent electrode 121 and metallic electrode 131 constitute the electrode X1 (X electrode). The transparent electrode 122 and metallic electrode 132 constitute the electrode Y1 (Y electrode). A dielectric 14 for sustaining wall charges is coated over the glass substrate 11, electrode X1 and electrode Y1. A protecting film 15 made of MgO is coated over the dielectric 14.

Address electrodes A1, A2, and A3 and barriers 171, 172, 173, and 174 are formed in a direction orthogonal to the electrodes X1 and Y1 on a surface of the glass substrate 16 opposed to the MgO protecting film 15. The barriers are intended to separate the address electrodes. A phosphor 181 on which ultraviolet rays stemming from discharge fall and which emits in turn red light is coated between the barriers 171 and 172. A phosphor 182 that emits green light is coated between the barriers 172 and 173. A phosphor 183 that emits blue light is coated between the barriers 173 and 174. The discharge spaces created between the phosphors 181 to 183 and the MgO protecting film 15A is sealed with, for example, Penning mixed gas of neon and xenon.

The barriers 171 to 174 function as spacers for preventing ultraviolet rays stemming from discharge from falling on adjoining pixel locations and creating the discharge spaces. When the phosphors 181 to 183 are made of the same material, the PDP 10 is structured for monochrome display.

Figure 6:
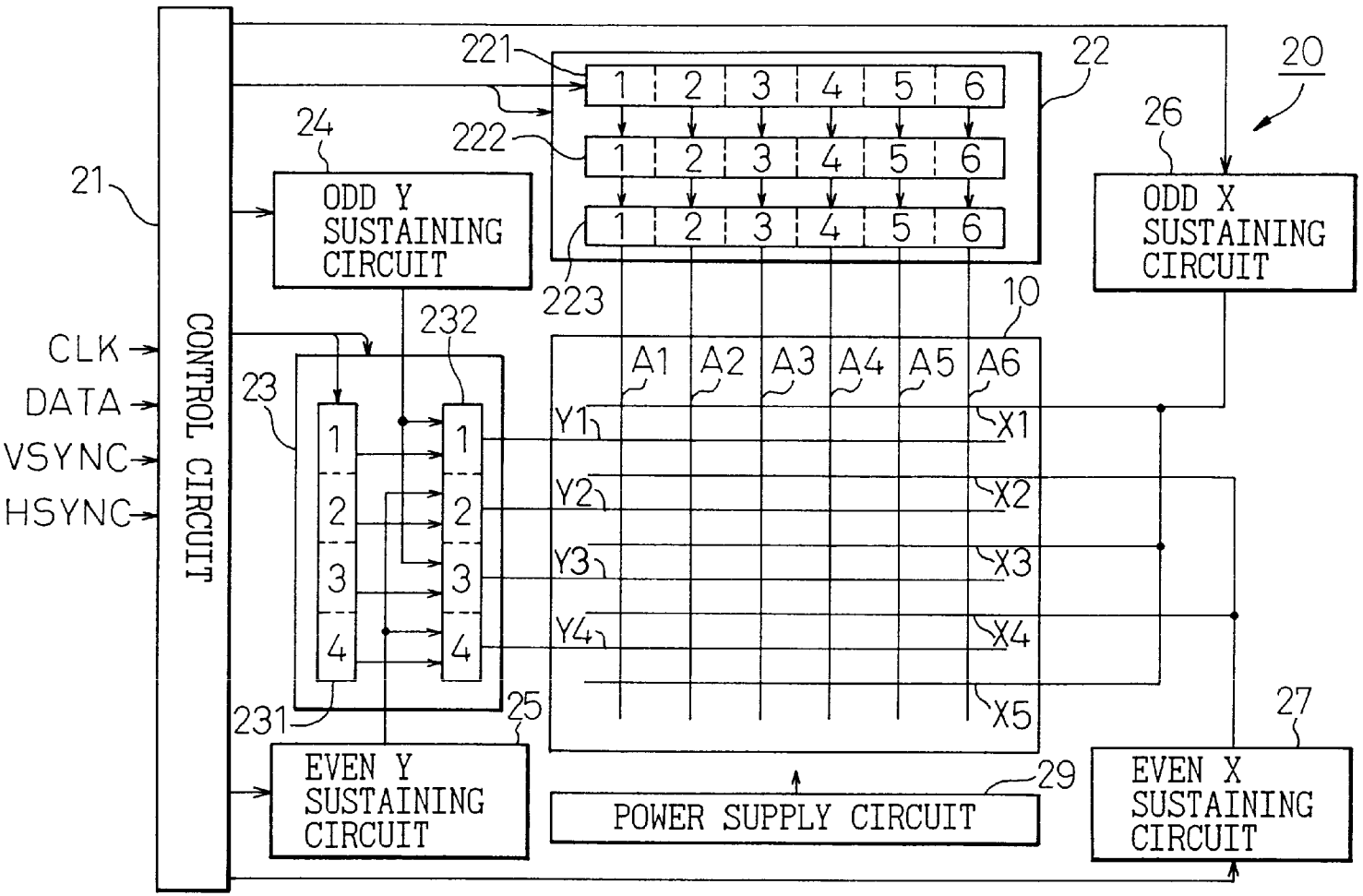
Fig.6 (PRIOR ART)
FIG. 6 is a block diagram schematically showing a plasma display device to which the PDP shown in FIG. 3 is adapted.

FIG. 6 is a block diagram showing the outline configuration of a plasma display device 20 to which the PDP shown in FIG. 3 is adapted.

As shown in FIG. 6, a control circuit 21 converts display data DATA supplied externally into data acceptable by the PDP 10. The control circuit 21 then supplies the data to a shift register 221 in an addressing circuit 22. Moreover, the control circuit 21 produces various control signals from a clock CLK, vertical sync signal VSYNC, and horizontal sync signal HSYNC which are supplied externally. The control signals are supplied to the addressing circuit 22, a scanning circuit 23, an odd Y sustaining circuit 24, an even Y sustaining circuit 25, an odd X sustaining circuit 26, and an even X sustaining circuit 27. In FIG. 6, numerals written in the shift register 221 identify elements that are mutually the same. For example, an element 221(3) of the shift register 221 handles a third bit. The same applies to the other shift register 231, a latch circuit 22, and drivers 223 and 232.

Figure 7:
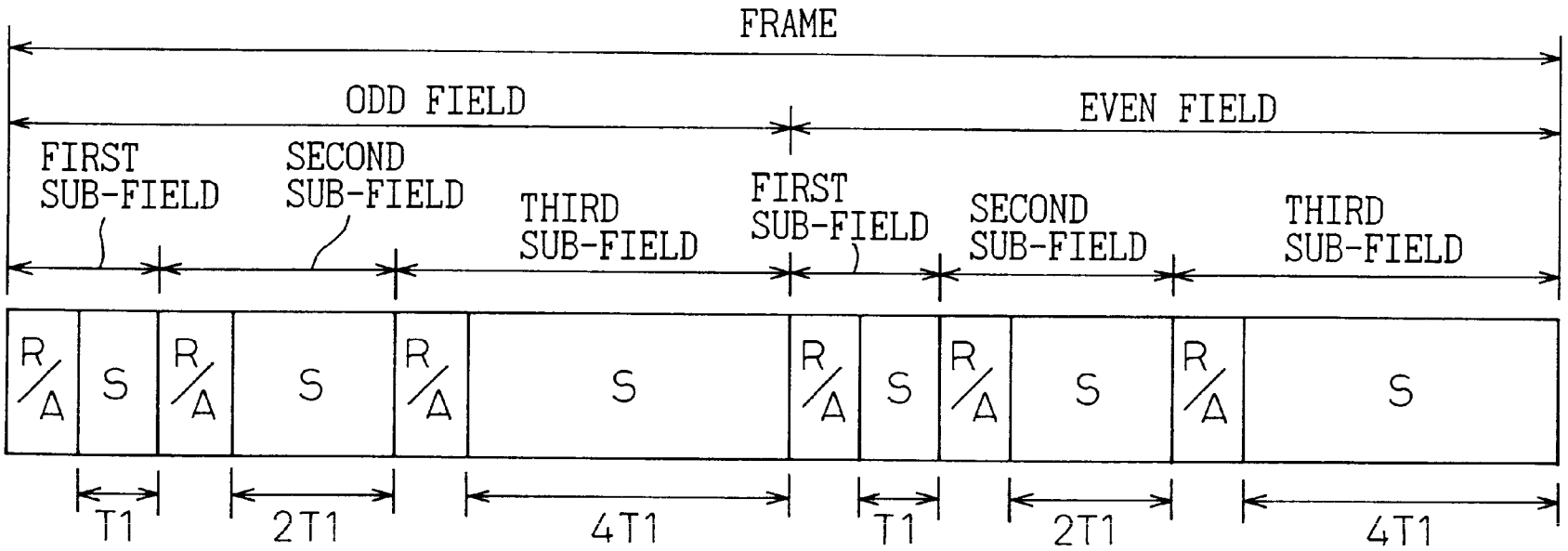
Fig.7 (PRIOR ART)
FIG. 7 shows a frame structure employed in a driving method to be implemented in the plasma display device shown in FIG. 6.
Figure 8A:
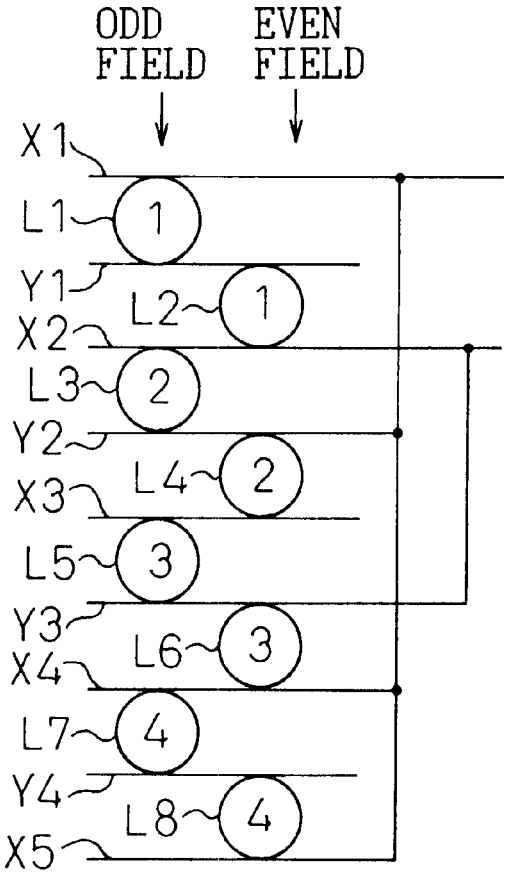
FIG. 8A and FIG. 8B are diagrams for explaining the driving method to be implemented in the plasma display device shown in FIG. 6.
Figure 8B:
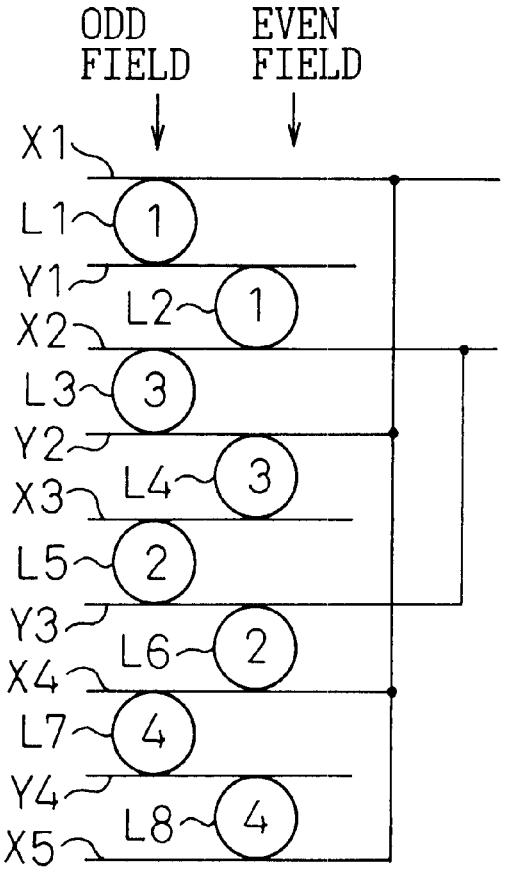
Figure 9:
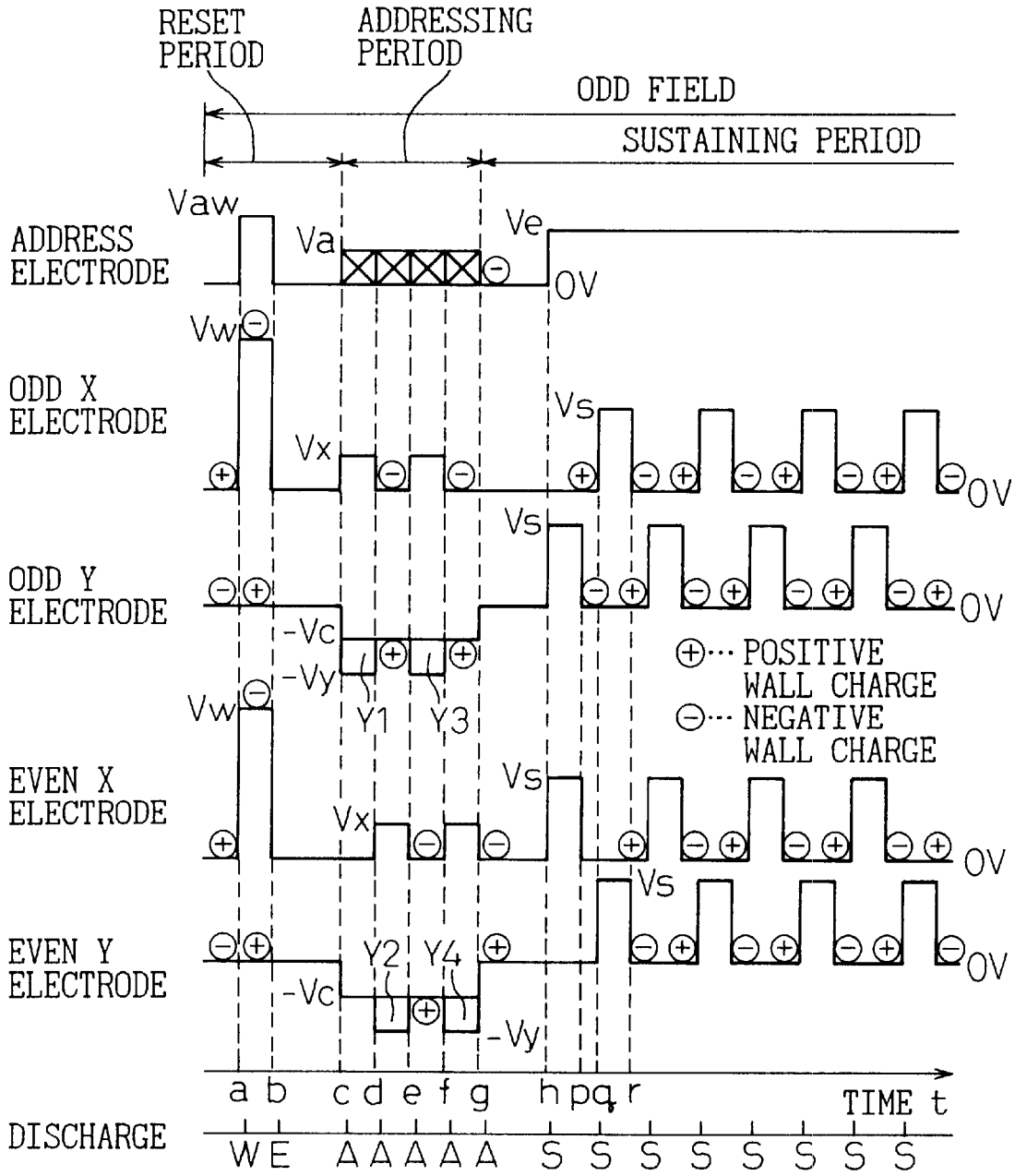
Fig.9 (PRIOR ART)
FIG. 9 shows waveforms of driving voltages to be applied during an odd field according to the driving method to be implemented in the plasma display device shown in FIG. 6.
Figure 10:
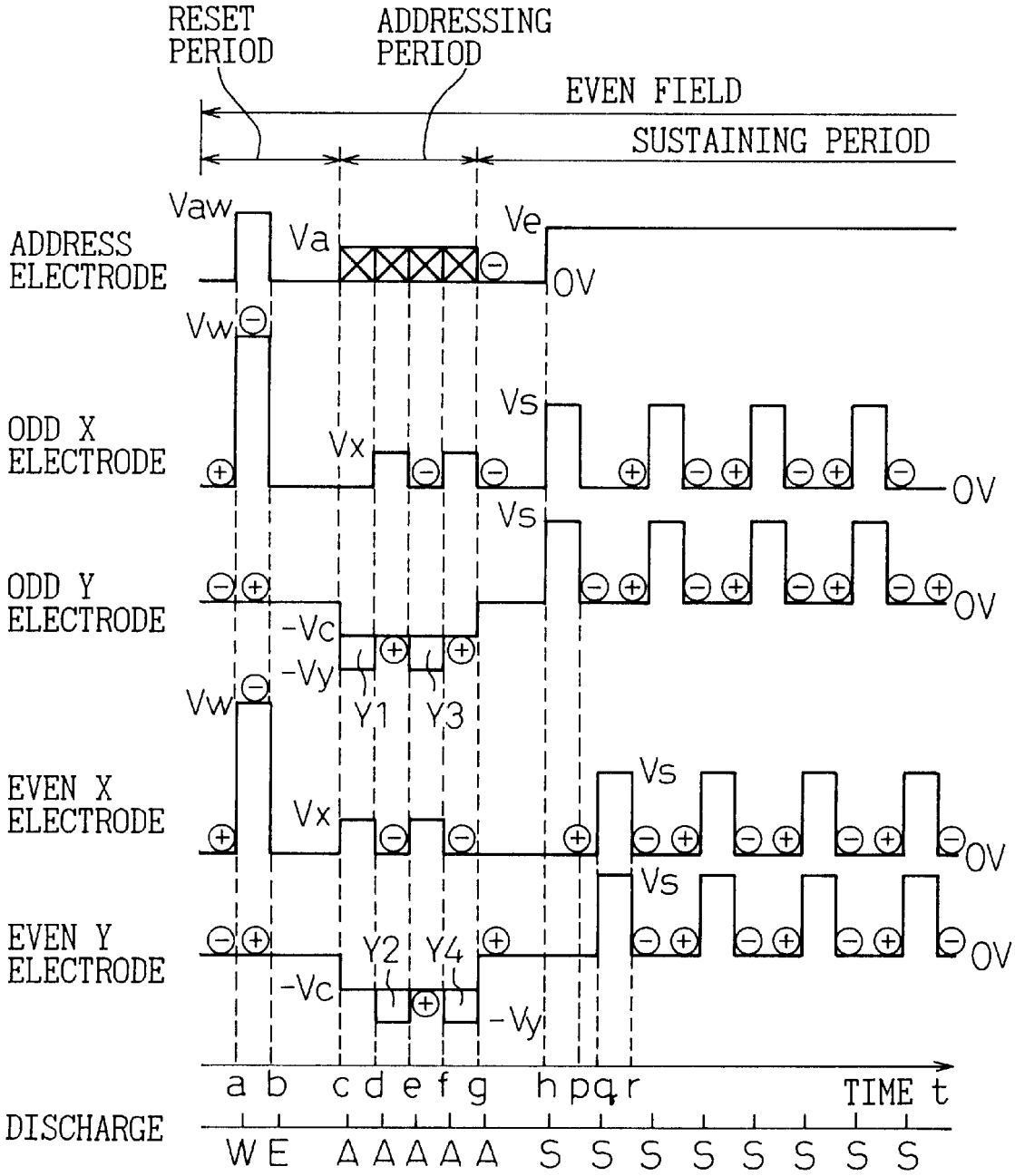
FIG. 10 shows waveforms of driving voltages to be applied during an even field according to the driving method to be implemented in the plasma display device shown in FIG. 6.

FIG. 7 shows a frame structure adopted in a driving method implemented in the plasma display device shown in FIG. 6. FIGS. 8A and 8B are diagrams for explaining the driving method implemented in the plasma display device shown in FIG. 6. Moreover, FIG. 9 shows waveforms of driving voltages applied over an odd field according to the driving method implemented in the plasma display device shown in FIG. 6. FIG. 10 shows waveforms of driving voltages applied over an even field according to the driving method implemented in the plasma display device shown in FIG. 6.

For applying the voltages shown in FIG. 9 and FIG. 10 to the electrodes, voltages Vaw, Va, and Ve are supplied from a power supply circuit 29 to the addressing circuit 22. Voltages −Vc, −Vy, and Vs are supplied to the odd Y sustaining circuit 24 and even Y sustaining circuit 25. Voltages Vw, Vx, and Vs are supplied to the odd X sustaining circuit 26 and even X sustaining circuit 27.

When display data for one display line is supplied from the control circuit 21 to the shift register 221 during an addressing period, bits 221(1) to 221(6) are held as bits 222(1) to 222(6) in the latch circuit 222 in the addressing circuit 22. Switches (not shown) in the driver elements 223(1) to 223(6) are turned on or off according to the bits. A binary voltage of voltage Va or 0 V is applied to the address electrodes A1 to A6.

The scanning circuit 23 includes the shift register 231 and driver 232. Within the addressing period, a 1 is supplied to a series data input port of the shift register 231 over an initial addressing cycle during the cycle of each vertical sync signal VSYNC. The 1 is shifted synchronously with the addressing cycle. Depending on the bits 231(1) to 231(4) in the shift register 231, switches in the driver elements 232(1) to 232(4) are turned on or off. A select voltage −Vy or an unselect voltage −Vc is applied to the electrodes Y1 to Y4. In other words, the electrodes Y1 to Y4 are selected orderly with every shift in the shift register 231. The select voltage −Vy is applied to a selected electrode Y, and the unselect voltage −Vc is applied to unselected electrodes Y.

The voltages −Vy and −Vc are supplied from the odd Y sustaining circuit 24 and even Y sustaining circuit 25. During a sustaining period, a first sustaining pulse train is supplied from the odd Y sustaining circuit 24 to the odd-numbered electrodes Y1 and Y3 out of the Y electrodes via the driver elements 232(1) and 232(3). A second sustaining pulse train is 180° out of phase with the first sustaining pulse train. The second sustaining pulse train is supplied from the even Y sustaining circuit 25 to the even-numbered electrodes Y2 and Y4 out of the Y electrodes via the driver elements 232(2) and 232(4).

Among the circuits for handling the electrodes X (electrodes X1 to X5), the odd X sustaining circuit 26 supplies the second sustaining pulse train to the odd-numbered electrodes X1, X3, and X5 out of the X electrodes via the driver (not shown) during the sustaining period. The even X sustaining circuit 27 supplies the first sustaining pulse train to the even-numbered electrodes X2 and X4 out of the X electrodes. Moreover, during the reset period, the X sustaining circuits 26 and 27 supply a whole-surface writing pulse in common to the electrodes X1 to X5. Furthermore, during the addressing period, a pulse train whose cycle corresponds to two addressing cycles is, as shown in FIG. 9 and FIG. 10, supplied from the odd X sustaining circuit 26 to the odd-numbered electrodes X1, X3, and X5 out of the X electrodes in response to a scanning pulse. A pulse train that is 180° out of phase with the pulse train is supplied from the even X sustaining circuit 27 to the even-numbered electrodes X2 and X4 out of the X electrodes.

The circuits 223, 232, 24, 25, 26 and 27 are structured as switching circuits for turning on or off voltages supplied from the power supply circuit 29.

As shown in FIG. 7, one frame of a display image is divided into an odd field and an even field. Either of the fields is composed of first to third sub-fields. For displaying each sub-field of the odd field, the voltages having the waveforms shown in FIG. 9 are applied to the electrodes in the PDP 10. Consequently, the display lines L1, L3, L5, and L7 in FIG. 3 are lit to represent the sub-field image. For displaying each sub-field of the even field, the voltages having the waveforms shown in FIG. 10 are applied to the electrodes in the PDP 10. Consequently, the display lines L2, L4, L6, and L8 shown in FIG. 3 are lit to represent the sub-field image.

Sustaining periods during the first to third sub-fields construed as time intervals are illustrated as periods T1, 2T1, and 4T1. During each sub-field, sustaining discharge is carried out by the number of times proportional to the length of the sustaining period. Consequently, luminance of eight gray-scale levels is attained. In reality, for example, the number of sub-fields is eight, and the ratio of the sustaining periods is 1:2:4:8:16:32:64:128. Consequently, luminance is expressed with 256 gray-scale levels.

As shown in FIG. 8A, during the addressing periods, the display lines L1, L3, L5, and L7 are scanned in that order for displaying the odd field. The display lines L2, L4, L6, and L8 are scanned in that order for displaying the even field.

Next, actions to be performed for displaying the odd field will be described in conjunction with FIG. 9. In FIG. 9, whole-surface writing discharge, whole-surface self-erasing discharge, addressing discharge, and sustaining discharge occur at time instants W, E, A, and S respectively. For brevity's sake, X electrodes shall indicate the electrodes X1 to X5, and odd X electrodes shall indicate the electrodes X1, X3, and X5. Even X electrodes shall indicate the electrodes X2 and X4. Y electrodes shall indicate the electrodes Y1 to Y4, odd Y electrodes shall indicate the electrodes Y1 and Y3, and even Y electrodes shall indicate the electrodes Y2 and Y4. Address electrodes shall indicate the address electrodes A1 to A6. Moreover, a voltage Vfxy is a discharge start voltage causing discharge to start between adjoining X and Y electrodes. A voltage Vfay is a discharge start voltage causing discharge to start between an address electrode and Y electrode that are opposed to each other. A voltage Vwall is a wall voltage corresponding to a difference between a positive wall charge and negative wall charge stemming from discharge occurring between adjoining X and Y electrodes. Herein, for example, Vfxy=290 V and Vfay=180 V. Moreover, "between an address electrode and Y electrode" shall be referred to as "inter-A/Y electrode." The same applies to the other inter-electrode spaces.

To begin with, a voltage to be supplied to the X electrodes during the reset period is the same whole-surface writing pulse. A voltage to be supplied to the Y electrodes is the same voltage of 0 V. A voltage to be supplied to the address electrodes is the same intermediate-voltage pulse.

Initially (at a time instant t<a), the voltage applied to the electrodes is 0 V. Due to a last sustaining pulse applied during the sustaining period preceding the reset period, a positive wall charge exists at the positions of the X electrodes on the MgO protecting film 15 opposed to lit pixel locations. A negative wall charge exists at the positions of the Y electrodes thereon. Note that almost no wall charge exists at the positions of the X electrodes and Y electrodes opposed to unlit pixel locations.

First, during a period a≦t≦b, a reset pulse of a voltage Vw is supplied to the X electrodes, and an intermediate-voltage pulse of a voltage Vaw is supplied to the address electrodes. For example, the voltage Vw is 310 V and higher than the voltage Vfxy. Irrespective of whether or not a wall charge is present, whole-surface writing discharge W occurs between adjoining X and Y electrodes, that is, between the X and Y electrodes on the display lines L1 to L8. Electrons and positive ions stemming from the whole-surface writing discharge W are attracted to electric fields induced by the inter-X/Y electrode voltage Vw. This brings about wall charges of opposite polarities. Consequently, the electric-field intensity in the discharge spaces decreases. The discharge ceases in one to several microseconds. The voltage Vaw is about a half of the voltage Vw. When the reset pulse is applied, an inter-A/X electrode voltage and an inter A/Y electrode voltage are out of phase and assume nearly equal absolute values. An average of wall charges adhering to the phosphors due to discharge is therefore nearly 0.

When the reset pulse rises at the time instant t=b, that is, the applied voltages opposite in polarity to the wall voltages disappear, an inter-X/Y electrode wall voltage Vwall gets larger than the discharge start voltage Vfxy. This brings about whole-surface self-erasing discharge E. At this time, the potentials at the X electrodes, Y electrodes, and address electrodes are 0 V. It will hardly take place that a wall charge develops due to discharge. Ions and electrons are re-bonded within the discharge spaces and almost perfectly neutralized. In the spaces, few charges that could not be re-bonded are floating. These spatial charges will fill the role of a priming that facilitates discharge during the next addressing discharge. This is known as a priming effect.

Next, during the addressing discharge period, a voltage to be supplied to the odd X electrodes is the same voltage. A voltage to be supplied to the even X electrodes is the same voltage. A voltage to be supplied to unselected Y electrodes is the same voltage −Vc. The Y electrodes are selected in ascending order of the electrodes Y1 to Y4. A scanning pulse of a voltage −Vy is applied to selected electrodes. Unselected electrodes are dropped to the voltage −Vc. For example, Vc=Va=50 V and Vy=150 V.

During a period c≦t≦d, the scanning pulse of the voltage −Vy is supplied to the electrodes Y1. A writing pulse of a voltage Va is supplied to the address electrodes lying over pixel locations to be lit. Herein, the relationship of Va+Vy>Vfay is established. Addressing discharge occurs at the pixel locations to be lit. Consequently, wall charges of opposite polarities develop and discharge ceases.

During the addressing discharge, a pulse of a voltage Vx is supplied to the electrode X1 alone out of the electrodes X1 and X2 adjoining the electrode Y1. Assuming that an inter-X/Y electrode discharge start voltage to be triggered by the addressing discharge is Vxyt, the relationship of Vx+Vc<Vxyt<Vx+Vy<Vfxy is established. Writing discharge occurs between the X1 and Y1 electrodes on the display line L1. Wall charges of opposite polarities that will not be discharged by themselves are developed between the electrodes X1 and Y1. Consequently, the discharge ceases. Meanwhile, discharge does not occur between the electrodes X2 and Y1 on the display line L2.

During a period d≦t≦e, the scanning pulse of the voltage −Vy is supplied to the electrode Y2, and the pulse of the voltage Vx is supplied to the even X electrodes. The writing pulse of the voltage Va is supplied to the address electrodes lying over pixel locations to be lit. Likewise, writing discharge occurs between the electrodes X2 and Y2 on the display line L3, and wall charges of opposite polarities develop. Meanwhile, no discharge occurs between the electrodes X3 and Y2 on the display line L4. The same actions are performed during a period e≦t≦g.

As mentioned above, writing discharge for writing display data occurs at pixel locations to be lit, which constitute each display line, in order of the display lines L1, L3, L5, and L7. A positive wall charge develops at the positions of the Y electrodes, and a negative wall charge develops at the positions of the X electrodes.

Furthermore, during the sustaining period, a sustaining pulse train of the same phase and the same voltage Vs is supplied to the odd X electrodes and even Y electrodes. A sustaining pulse train that is 180° (half cycle) out of phase of the sustaining pulse train is supplied to the even X electrodes and odd Y electrodes. Moreover, a voltage Ve is applied to the address electrodes at the leading edge of the first sustaining pulse. The voltage Ve is sustained until the sustaining period comes to an end.

During a period h≦t≦p, a sustaining pulse of the voltage vs is supplied to the odd Y electrodes and even X electrodes. The root-mean-square voltage at pixel locations lying between each odd Y electrode and odd X electrode becomes Vs+Vwall. The root-mean-square voltage at pixel locations lying between each even X electrode and even Y electrode becomes Vs−Vwall. The root-mean-square voltage at pixel locations lying between each odd X electrode and even Y electrode or between each even X electrode and odd Y electrode becomes 2Vwall. Herein, the relationships of Vs<Vfxy<Vs+Vwall and 2Vwall<Vfxy are established. Consequently, sustaining discharge occurs between each adjoining odd Y electrode and odd X electrode. Wall charges of opposite polarities develop, and the discharge ceases. Sustaining discharge does not occur between the other electrodes. Visualization of all the odd display lines L1, L3, L5, and L7 is therefore validated during the odd field.

The foregoing sustaining discharge is repeated. In this case, as apparent from FIG. 9, the root-mean-square voltage at pixel locations between each odd Y electrode and even X electrode on a non-representation display line is 0 due to the wall charges. Likewise, the root-mean-square voltage at pixel locations between each odd X electrode and even Y electrode is 0 due to the wall charges. The last sustaining discharge occurring during the sustaining period is carried out so that the polarities of wall charges will be the same as those attained at the start of the reset period.

The actions performed during the odd field have been described. Next, actions to be performed during the even field will be described.

In FIG. 3, visualization of the display lines L1, L3, L5, and L7 is validated during the odd field. The display lines L1, L3, L5, and L7 are each defined between each pair of the electrodes Y1 to Y4 and the electrodes X1 to X4 adjoining above the electrodes Y1 to Y4 in FIG. 3. During the even field, visualization of the display lines L2, L4, L6, and LB is validated. The display lines L2, L4, L6, and LB are each defined between each pair of the electrodes Y1 to Y4 and the electrodes X2 to X5 adjoining below the electrodes Y1 to Y4 in FIG. 3. This is accomplished by reversing the roles of the electrodes X1 and X2 relative to the electrode Y1, and the roles of the electrodes X2 and X3 relative to the electrode Y2. The same applies to the other pairs of X electrodes. Specifically, voltages to be supplied to the groups of odd X electrodes and even X electrodes are switched. FIG. 10 shows waveforms of voltages to be applied to the electrodes during the even field.

Actions to be performed during the even field are apparent from the above description and FIG. 10. In short, whole-surface writing discharge W and whole-surface self-erasing discharge E are carried out during the reset period. During the addressing period, the electrodes Y1 to Y4 are selected in that order. Writing discharge for writing display data is carried out on each display line in order of the display lines L2, L4, L6, and L8. Sustaining discharge is repeated simultaneously on the display lines L2, L4, L6, and L8 during the sustaining period.

As described with reference to FIG. 3 to FIG. 10, as far as a surface discharge AC type PDP is concerned, the display lines to be lit for representing an image during the odd field and the display lines to be lit therefor during the even field do not interact relative to discharge. The present invention is implemented mainly in the surface discharge AC type PDP. The barriers 191 to 199 can therefore be removed from the PDP 10Q shown in FIG. 2. Consequently, the PDP can be manufactured easily and priced low. Furthermore, the pitch between adjoining pixels can be diminished and higher-definition display can be achieved.

Next, a mention will be made of a conventional plasma display device (surface discharge AC type PDP) in which the alternate lighting of surfaces (ALIS) method adopting the technology described in conjunction with FIG. 3 to FIG. 10 is implemented.

Figure 11:
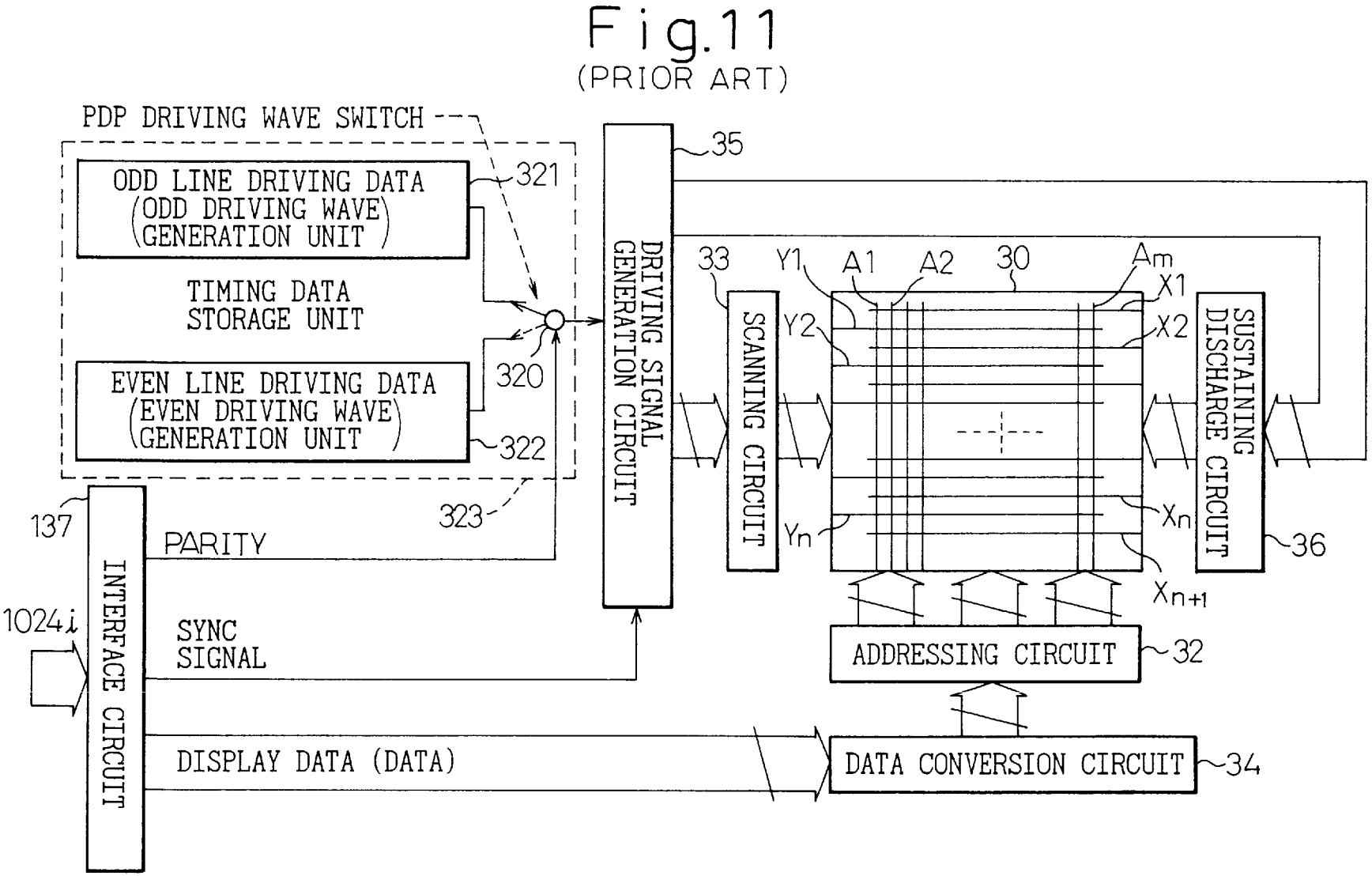
Fig.11 (PRIOR ART)
FIG. 11 is a block diagram schematically showing a conventional plasma display device to which an ALIS method is implemented.
Figure 12:
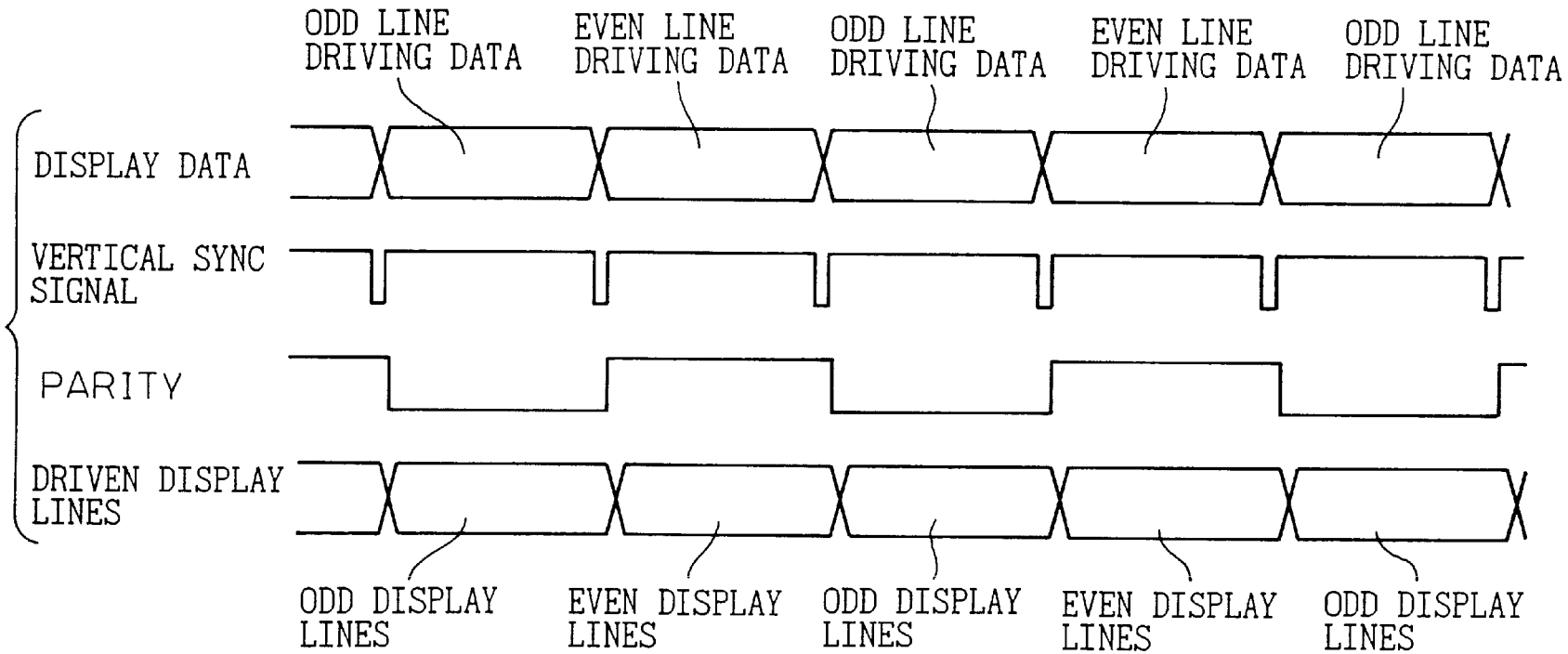
FIG. 12 is a diagram for explaining the actions of the plasma display device shown in FIG. 11.

FIG. 11 is a block diagram showing the outline configuration of a conventional plasma display device in which the ALIS method is implemented. FIG. 12 is a diagram for explaining the actions of the plasma display device shown in FIG. 11. In FIG. 11, there are shown a PDP 30, an addressing circuit 32, a timing data storage unit 323, a data conversion circuit 34, a driving signal generation circuit 35, a sustaining discharge circuit 36, and an interface circuit 137.

The timing data storage unit 323 contains odd line driving data (odd driving wave generation unit) 321, and even line driving data (even driving wave generation unit) 322, and includes a selector means 320. Display data DATA is supplied to the data conversion circuit 34 and converted into data acceptable by the PDP 30. The resultant data is supplied to address electrodes A1 to Am via the addressing circuit 32. The sustaining discharge circuit 36 corresponds to the odd X sustaining circuit 26 and even X sustaining circuit 27 shown in FIG. 6. Moreover, a scanning circuit 33 corresponds to the scanning circuit 23, odd Y sustaining circuit 24, and even Y sustaining circuit 25 shown in FIG. 6.

The ALIS method shown in FIG. 11 is implemented in the plasma display device. When a video signal is input to the interface circuit 137, display lines to be lit are determined with timing signals contained in the input video signal. The video signal represents a high-definition television picture composed of 1024 interlaced scanning lines. The timing signals are vertical sync signal and horizontal sync signal. Furthermore, as shown in FIG. 12, the interface circuit 137 produces a parity signal of a logic level associated with the display lines to be lit. Display data is switched according to the logic level of the parity signal. When a video signal indicating the odd display lines is input (the parity signal is low), the odd display lines are selected and lit to represent an image. When a video signal indicating the even display lines is input (the parity signal is high), the even display lines are selected and lit to represent an image. These actions are performed alternately. In other words, in the plasma display device shown in FIG. 11, the display lines are switched field by field. Thus, 1024 interlaced scanning lines represented by the signal are displayed.

As mentioned above, the PDP described with reference to FIG. 3 to FIG. 10 will not invite deterioration of image quality but can display an image by interlacing an even field and odd field.

Incidentally, a plasma display device adopting the PDP shown in FIG. 3 is used as display devices for various types of equipment. For example, the plasma display device may be used as a display device of an automatic teller machine (ATM) to be installed at banks. In this case, a specified screen (for example, welcome-to-our bank screen) is kept displayed until a user (customer) uses the ATM. Even when the plasma display device is used as display devices for other various apparatuses, a specified steady screen may often have to be displayed continuously.

When a specified screen is displayed continuously for a prolonged period of time, phosphors and a protecting film that are components of a PDP may deteriorate. Otherwise, sticking of the specified screen occurs in a screen.

Moreover, assume that an input picture is an ordinary-definition television picture consisting of 512 progressive scanning lines and conforming to the NTSC, PAL, or SECAM. In this case, it is unnecessary to switch the display lines. The parity signal is therefore not switched from one to the other. The same display lines remain lit.

Assume that the same display lines are continuously lit, and that the display lines being lit are compared with those not lit. A difference in glowing efficiency of phosphors is larger than that observed when the display lines are alternately selected. Assume that the glowing efficiency of the phosphors on the display lines being lit is compared with that on the display lines not lit. In this case, the glowing efficiency of the phosphors on the display lines being lit is much poorer. This may cause shading in the direction of the lines. For allowing deterioration of the phosphors to progress at the same pace between the even and odd display lines, the display lines may be switched as frequently as field by field as set forth in the ALIS method. A picture consisting of 512 progressive scanning lines may thus be displayed. However, the frequent switching of the display lines causes flickers. Incidentally, deterioration of glowing efficiency of phosphors is intensified with a higher frequency of a sustaining voltage.

Referring to the appended drawings, a description will be made of the principles and embodiments of a plasma display device and a method of driving a plasma display panel in accordance with the present invention.

Figure 13:
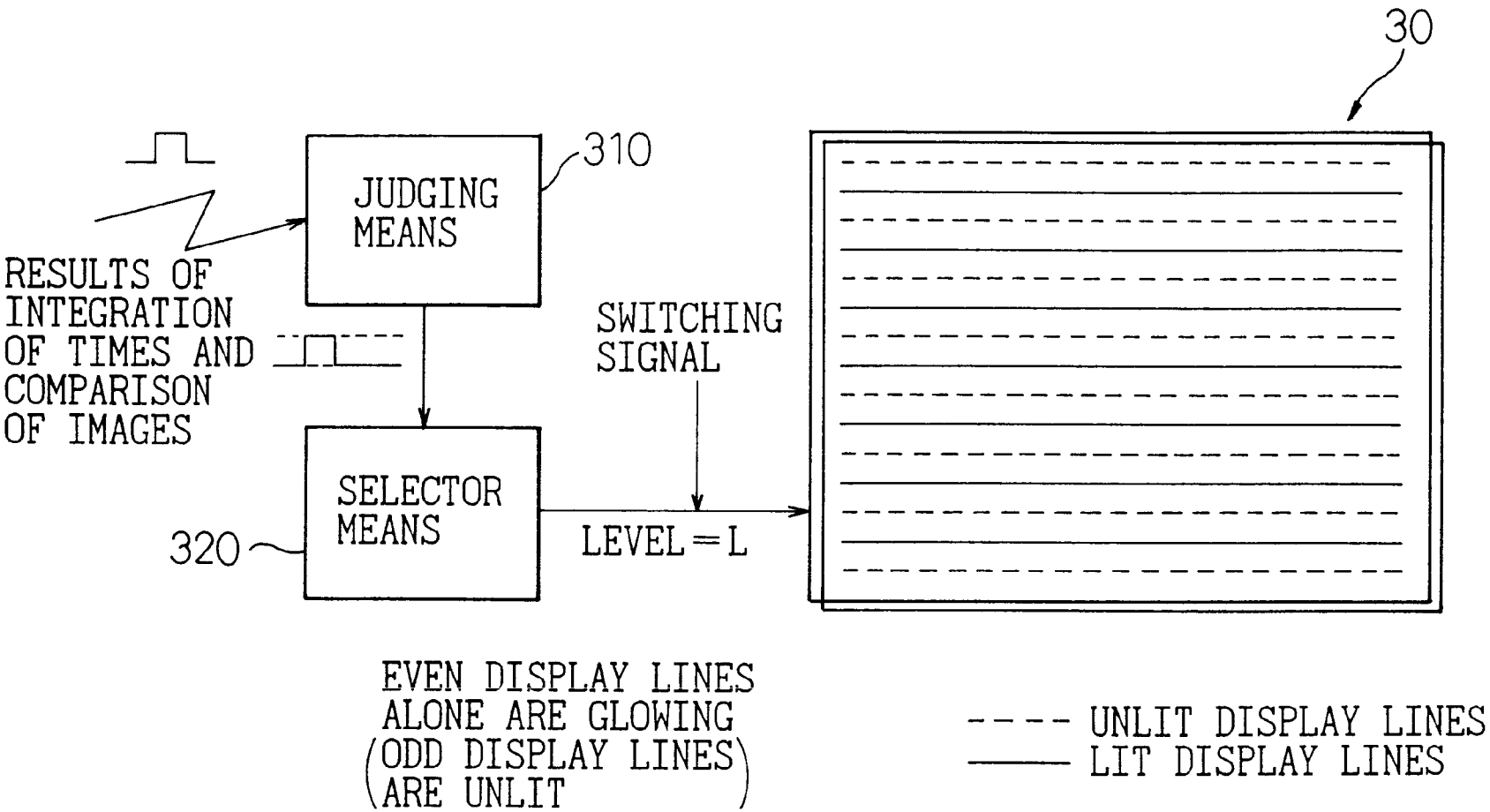
FIG. 13 and FIG. 14 are diagrams for explaining the principles and configuration of a plasma display device in accordance with the present invention.
Figure 14:
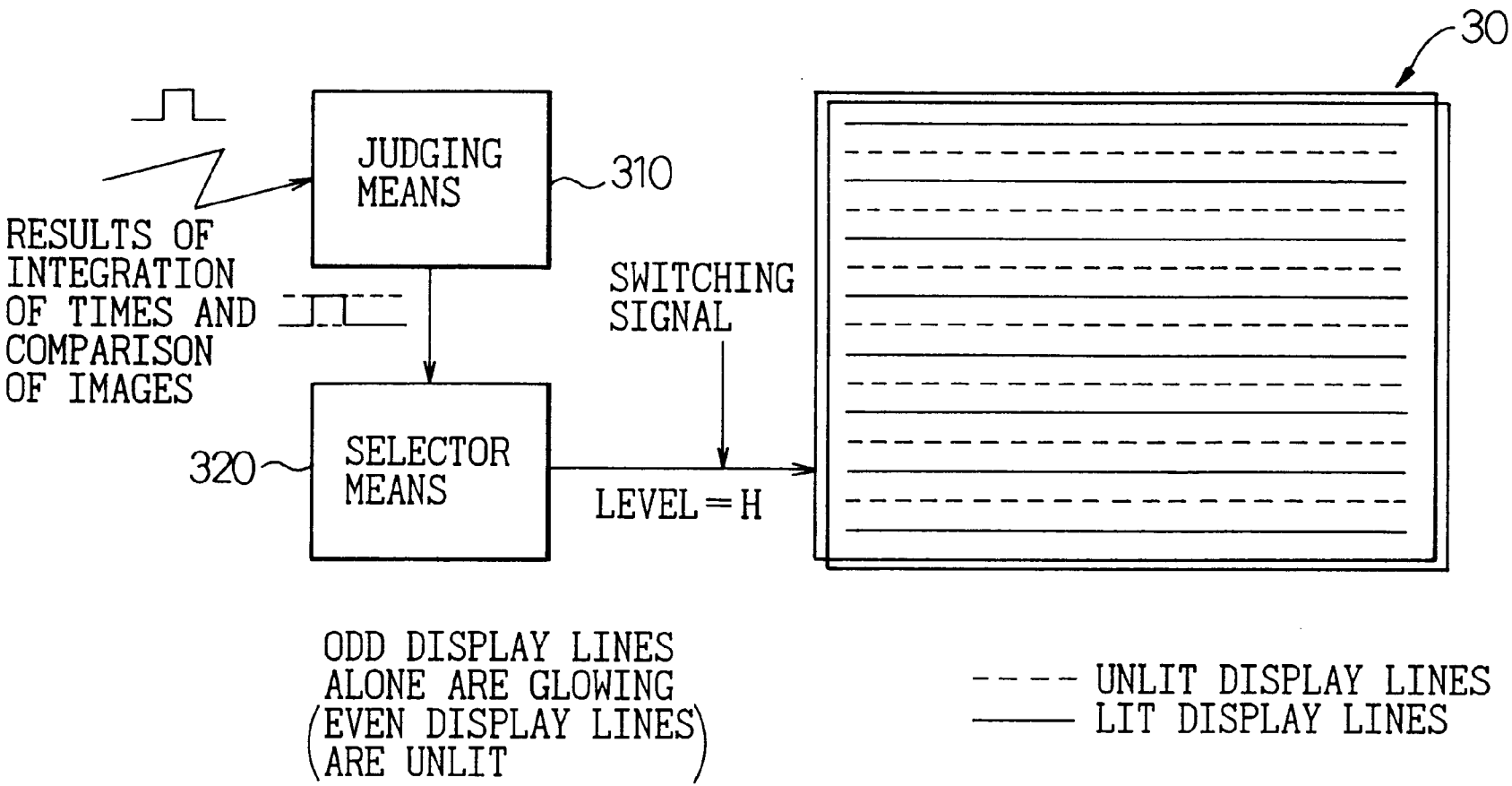

FIG. 13 and FIG. 14 are diagrams for explaining the principles and configuration of a plasma display device in accordance with the present invention. In FIG. 13 and FIG. 14, there are shown a plasma display panel 30, a judging means 310, and a selector means 320. The PDP 30 corresponds to the PDP 10 shown in FIG. 3 or the PDP 3 shown in FIG. 11.

As shown in FIG. 13 and FIG. 14, the judging means 310 judges the conditions for an image to be displayed. Based on the results of judgment made by the judging means 310, the selector means 320 selects whether to allow the odd display lines alone or even display lines alone to glow. When the odd display lines alone are lit, the even display lines are unlit. When the even display lines alone are lit, the odd display lines are unlit.

To be more specific, when an image to be displayed is a steady image (an initial operation image persisting until a predetermined operation is carried out), the image is displayed as an image represented by the odd display lines. Images other than the steady image (a plurality of images designated using the initial operation image) are displayed as images represented by the even display lines.

Sticking of a steady image or the same image being displayed for a prolonged period of time, such as an initial operation image occurs only in an image represented by the odd display lines. A plurality of images designated using the initial operation image is displayed as images represented by the even display lines and devoid of sticking. The steady image causing sticking and the other ordinary images are distinguished from each other by discriminating the odd display line from the even display lines. Consequently, sticking in a screen in which any ordinary image appears becomes less discernible.

Moreover, a display time required by an image to be displayed is calculated by a display time integrating means. Based on the calculated display time, the selector means switches image display based on the even display lines and image display based on the odd display lines. Otherwise, an image comparing means detects a change of images to be displayed. Based on the detected change of images, the selector means switches image display using the even display lines and image display using the odd display lines.

This makes it possible to extend the service lives of phosphors and a protecting film and prevent sticking in a screen.

Figure 15:
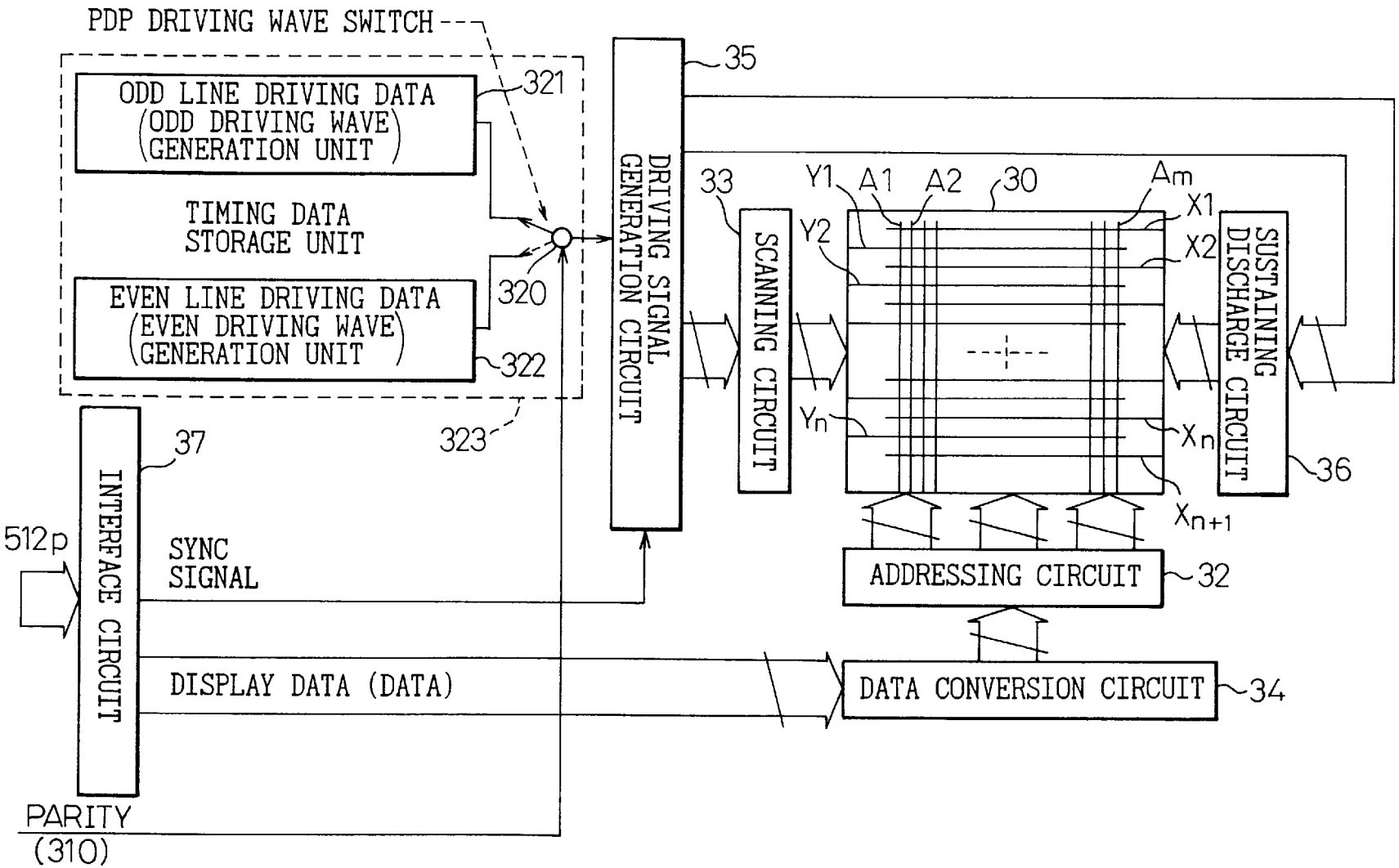
FIG. 15 is a block diagram showing the outline configuration of a first embodiment of a plasma display device in accordance with the present invention.
Figure 16:
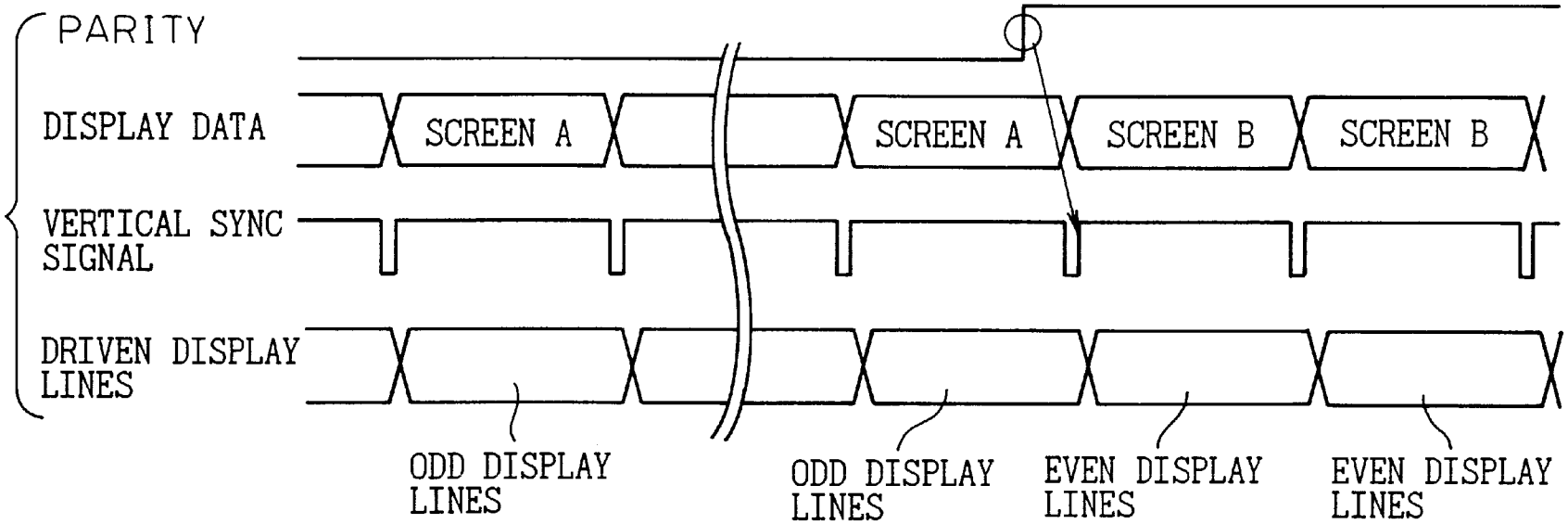
FIG. 16 is a diagram for explaining the actions of the plasma display device shown in FIG. 15.

FIG. 15 is a block diagram showing the outline configuration of the first embodiment of a plasma display device in accordance with the present invention, and FIG. 16 is a diagram for explaining the actions of the plasma display device shown in FIG. 15. In FIG. 15, there are shown a PDP 30, an addressing circuit 32, a timing data storage unit 323, a data conversion circuit 34, a driving signal generation circuit 35, a sustaining discharge circuit 36, and an interface circuit 37.

The timing data storage unit 323 has odd line driving data (odd driving wave generation unit) 321 and even line driving data (even driving wave generation unit) 322, and includes a selector means 320. Display data DATA is supplied to the data conversion circuit 34 and converted into data acceptable by the PDP 30. The data is then supplied to address electrodes A1 to Am via the addressing circuit 32. These components are identical to those of the plasma display device shown in FIG. 11. The sustaining discharge circuit 36 corresponds to the odd X sustaining circuit 26 and even X sustaining circuit 27 shown in FIG. 6. Moreover, a scanning circuit 33 corresponds to the scanning circuit 23, odd Y sustaining circuit 24, and even Y sustaining circuit 25 shown in FIG. 6.

One of the odd line driving data (321) and even line driving data (322) selected by the selector circuit 320 is supplied to the driving signal generation circuit 35. A representation by the odd display lines or even display lines is displayed by the PDP 30 according to the odd line driving data or even line driving data. The PDP shown in FIG. 3 or FIG. 11 is adaptable to the PDP 30. Moreover, the configurations and actions of the PDP 30, addressing circuit 32, and scanning circuit 33 are identical to those of the conventional plasma display device described with reference to FIG. 3 to FIG. 10.

As apparent from the comparison between FIG. 15 and FIG. 11, in the first embodiment, a parity signal (for example, an output of the judging means 310 in FIG. 13 and FIG. 14) is supplied to the selector circuit 32 for switching driving waves to be applied to the PDP 30. The parity signal is not output via the interface circuit 137 shown in FIG. 11 but is supplied directly externally.

As shown in FIG. 16, display data is switched from one to another according to the logic level of the externally supplied parity signal. Specifically, when the parity signal is low, the odd display lines (odd line driving data 321) are selected to represent image A. When the parity signal is high, the even display lines (even line driving data 322) are selected to represent image B.

Specifically, for example, assume that a plasma display device can display a picture (high-definition television picture) composed of 1024 interlaced scanning lines. Assume that a picture composed of 512 progressive scanning lines conformable to the NTSC, PAL, or SECAM (ordinary-definition television picture) is input to the plasma display device. In this case, the level of the parity signal is changed at intervals of a predetermined time (for example, at intervals of one hour). A representation (image A) by the odd display lines and a representation (image B) by the even display lines are switched accordingly. Deterioration of the phosphors at the positions of the odd display lines and even display lines thus makes progress at the same pace. Moreover, since the odd display lines and even display lines that represent images are switched at intervals of the predetermined time, deterioration of the phosphors themselves can be minimized. The timing of changing the level of the parity signal is construed as the timing of switching image A and image B. The timing is determined so that image A and image B will be switched at intervals of a time (for example, about one hour) neither giving an observer (user) a feeling of flickering nor causing deterioration of the phosphors.

Thus, the plasma display device capable of displaying a high-definition television picture can also display an ordinary-definition television picture without any difference in deterioration of the phosphors between the even display lines and odd display lines. The high-definition television picture is composed of 1024 interlaced scanning lines, while the ordinary-definition television picture is composed of 512 progressive scanning lines.

Figure 17:
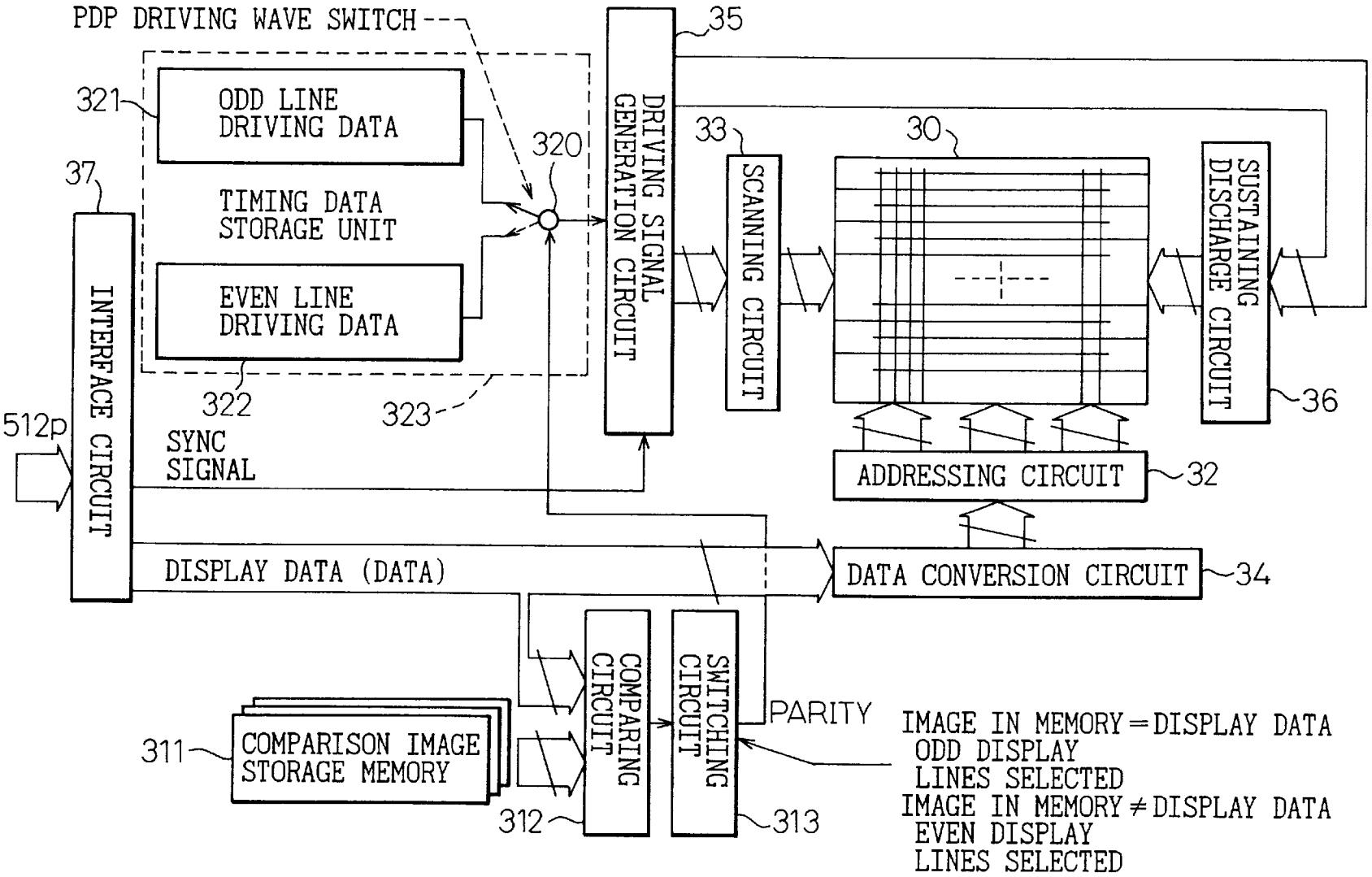
FIG. 17 is a block diagram showing the outline configuration of a second embodiment of a plasma display device in accordance with the present invention.
Figure 18:
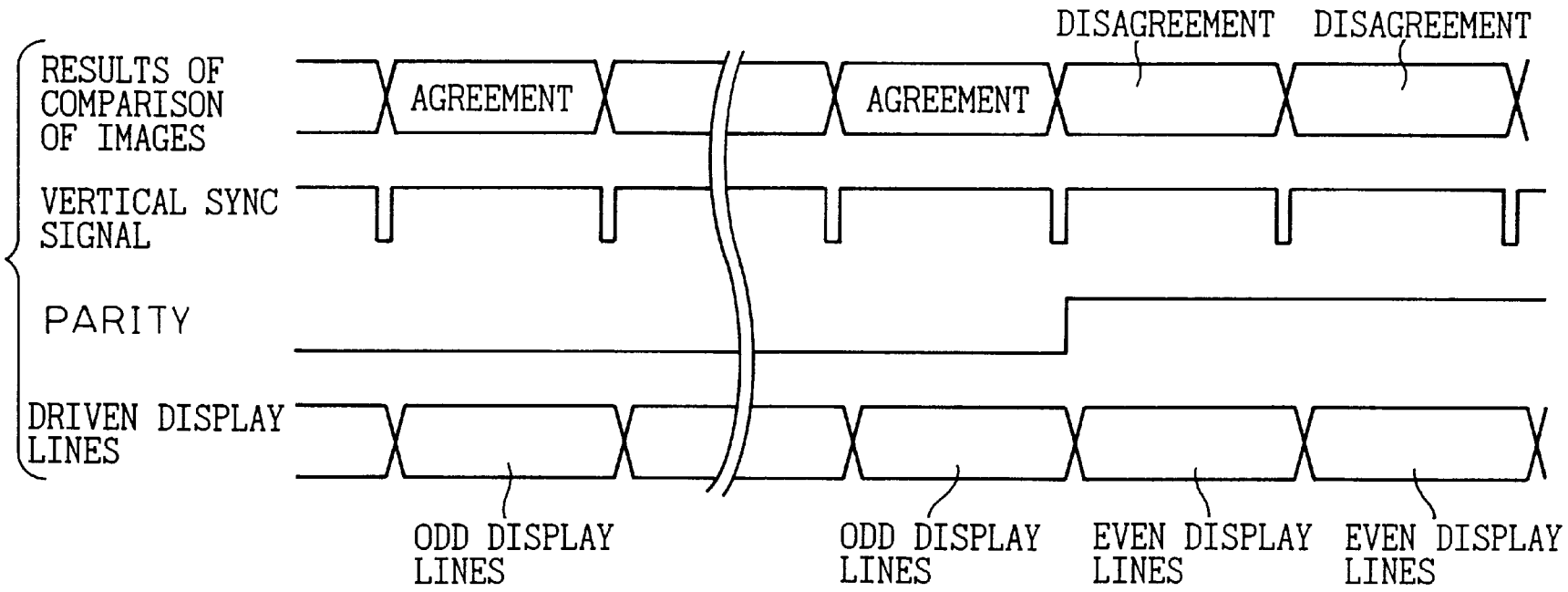
FIG. 18 is a diagram for explaining the actions of the plasma display device shown in FIG. 17.
Figure 19:
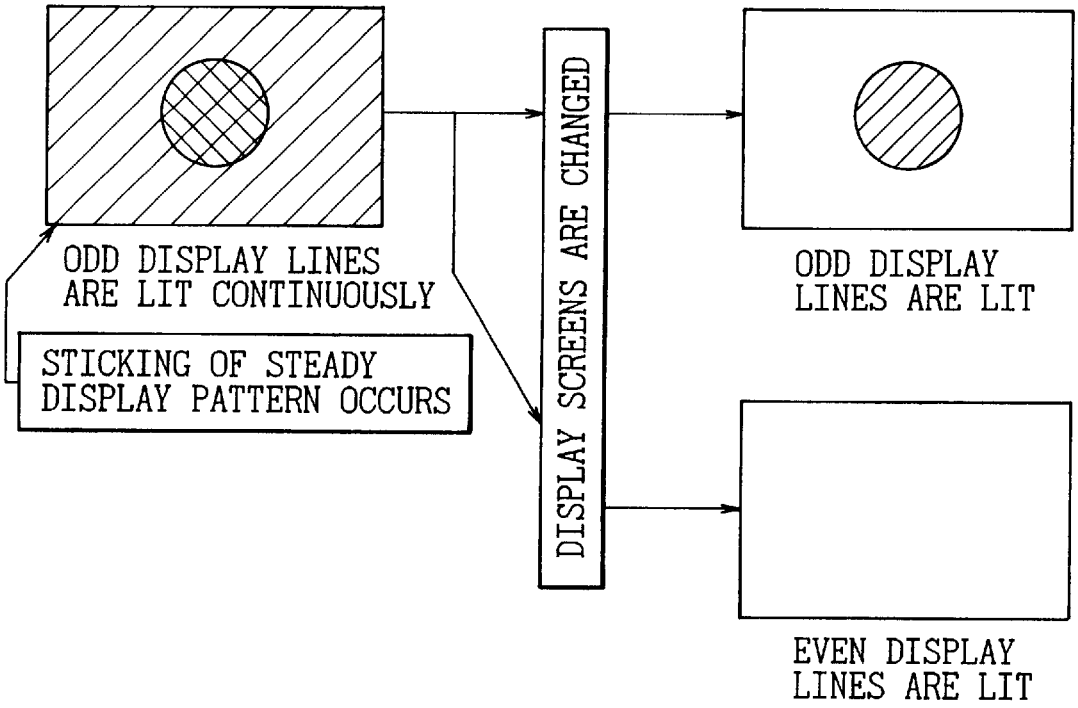
FIG. 19 is a diagram for explaining the actions of the second embodiment shown in FIG. 17.

FIG. 17 is a block diagram showing the outline configuration of the second embodiment of a plasma display device in accordance with the present invention, and FIG. 18 and FIG. 19 are diagrams for explaining the actions of the plasma display device shown in FIG. 17. In FIG. 17, there are shown a comparison image storage memory 311, a comparison circuit 312, and a switching circuit 313.

As shown in FIG. 17, according to the second embodiment, a predetermined steady image is stored in advance in the comparison image storage memory 311. The image data stored in the comparison image storage memory 311 is compared with display data DATA by the comparison circuit 312. As shown in FIG. 18, for example, assume that the image data stored in the comparison image storage memory agrees with the display data DATA (image stored in the comparison image storage memory 311=display data). In this case, the parity signal (output of the switching circuit 313) is driven low and the image (display data DATA) is displayed using the odd display lines according to the odd line driving data (321). By contrast, assume that the image data and display data disagree with each other (image stored in the comparison image storage memory 311≠display data). In this case, the parity signal is driven high, and the image is displayed using the even display lines according to the even line driving data (322).

As shown in FIG. 19, for example, a steady display pattern (steady image) may be displayed as a representation by the odd display lines for a prolonged period of time. In this case, sticking of the steady image occurs. Once sticking of the steady image occurs, when any image other than the steady image is displayed, the sticking of the steady image is discernible. In particular, for example, when the plasma display device is used as a display device for an automatic teller machine (ATM), if a specified steady image (for example, a welcome-to-our bank screen) is kept displayed until a user uses the ATM, the welcome-to-our bank screen sticks.

In the second embodiment, a steady image (for example, a welcome-to-our bank screen) is stored in the comparison image storage memory 311. When display data DATA agrees with the steady image, the switching circuit 313 outputs a low-level parity signal. The display data DATA (welcome-to-our bank screen) is expressed by the odd display lines or, one of the even display lines and odd display lines. As a result, sticking of a steady image occurs only in a representation by the odd display lines.

On the other hand, for displaying an ordinary image that is different from the steady image (welcome-to-our bank screen) stored in the comparison image storage memory 311, a high-level parity signal is output from the switching circuit 313. The ordinary image is any image other than the specified steady image handled by the display device for the ATM. The ordinary image is, for example, an image depicting an entry for depositing money, drawing money, or filling out a bankbook which is selected in the welcome-to-our bank screen. The display data DATA (ordinary image) is displayed using the even display lines free from the sticking of the steady image.

As mentioned above, according to the second embodiment, an image to be displayed may be a steady image (for example, an initial operation image persisting until a predetermined operation is carried out). In this case, the image is displayed as an image represented by the odd display lines. When the image to be displayed is any image other than the steady image (a plurality of images designated using the initial operation image), the image is displayed as an image represented by the even display lines. Sticking of a steady image such as the initial operation image therefore occurs only in, for example, an image represented by the odd display lines. A plurality of images designated using the initial operation image is each displayed as an image represented by, for example, the even display lines free from sticking. In other words, a steady image causing sticking and the other ordinary images are distinguished from each other by discriminating a representation by the odd display lines from a representation by the even display lines. Thus, sticking in a screen in which an ordinary image is displayed becomes less discernible. An image to be held in the comparison image storage memory 311 may be solely, for example, the initial operation image. Alternatively, a plurality of images may be stored in the comparison image storage memory 311.

Figure 20:
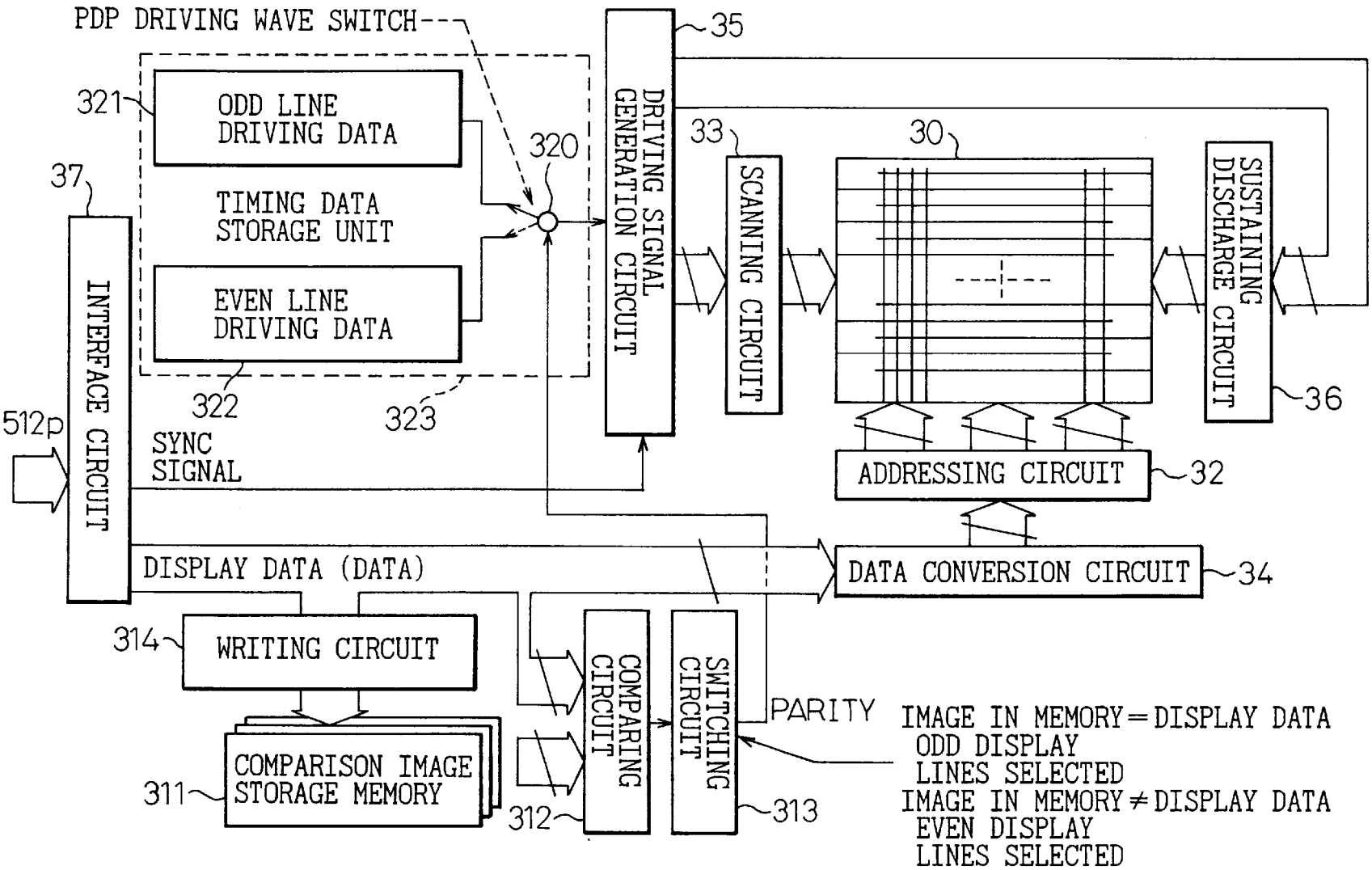
FIG. 20 is a block diagram schematically showing a third embodiment of a plasma display device in accordance with the present invention.

FIG. 20 is a block diagram showing the outline configuration of the third embodiment of a plasma display device in accordance with the present invention. In FIG. 20, there is shown a writing circuit 314.

As shown in FIG. 20, the comparison image storage memory 311 stores an image to be compared with another. In the third embodiment, unlike the second embodiment, actual display data (DATA) is successively written in the form of frames (fields), which are compared with a stored image, in the comparison image storage memory 311 by means of the writing circuit 314. The comparison circuit 312 compares image data stored in the comparison image storage memory 311 (for example, image data of an immediately preceding frame) with display data DATA supplied via the interface circuit 37. When the display data DATA agrees with (=) the previous image stored in the comparison image storage memory 311, the parity signal (output of the switching circuit 314) is driven low. The image represented by the display data is displayed using the odd display lines according to the odd line driving data (321). When the display data disagrees with (≠) the previous image stored in the comparison image storage memory 311, the parity signal is driven high. The image represented by the display data is displayed using the even display lines according to the even line driving data (322).

For switching the display lines to the others as a result of comparison of images, first, display data may stored in the form of frames (fields) and compared with a previous image. Depending on the magnitude of a difference between the images, for example, when a steady image persists for a period coincident with a predetermined number of frames, the display lines may be switched to the others. However, for example, when the same screen, for example, the welcome-to-our bank screen adopted for an ATM is displayed for a very long period of time, sticking is somewhat unavoidable. During display of the same steady screen, the same display lines (for example, odd display lines) are used for display. When the screen is switched to another, the display lines may be switched to the others (for example, to the even display lines). Thus, sticking in a screen is made less discernible. At this time, when the screen is returned to the previous one (for example, steady screen), the display lines are also returned to the original ones (odd display lines).

Figure 21:
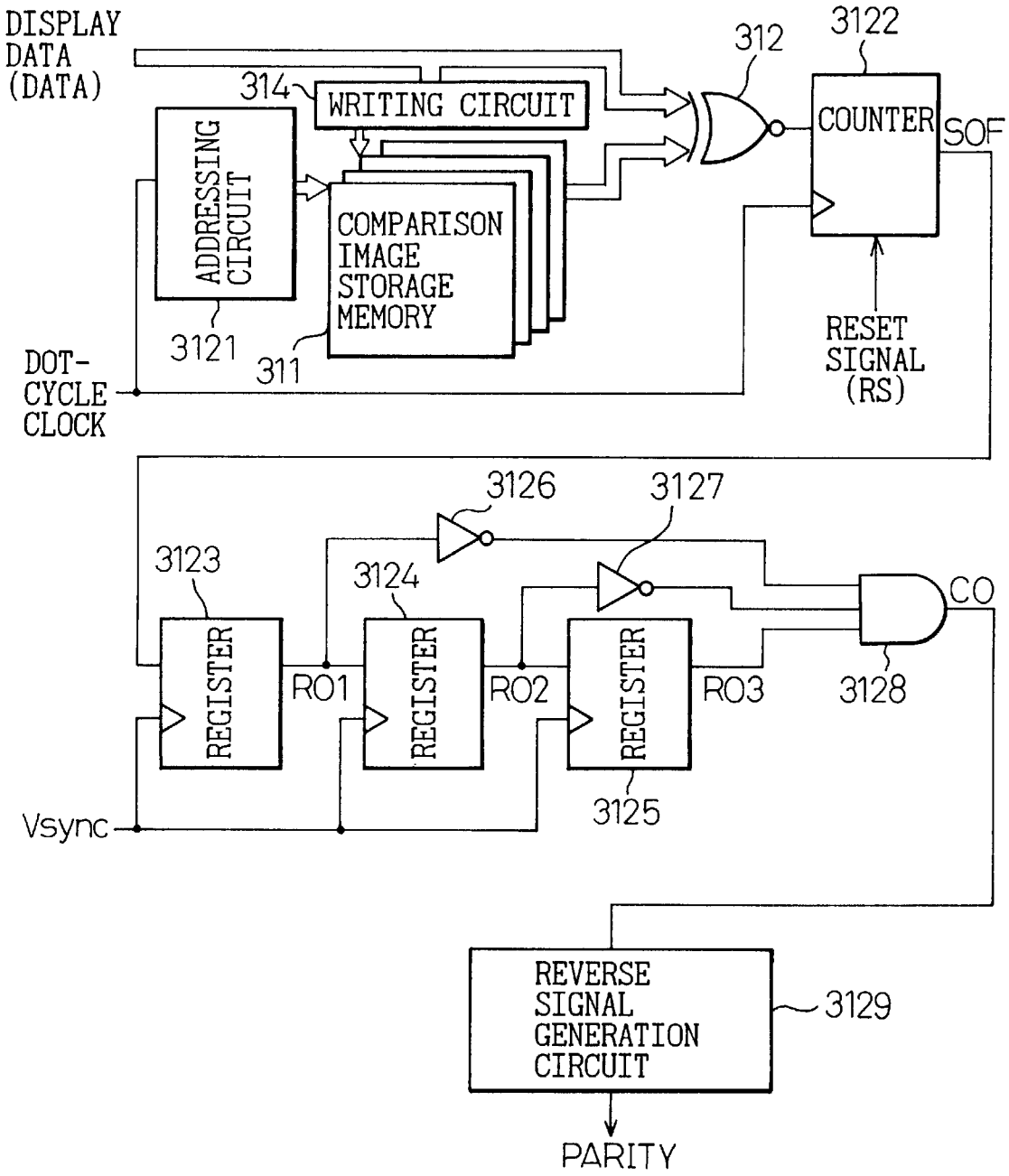
FIG. 21 is a block diagram showing a variant of the third embodiment shown in FIG. 20.
Figure 22:
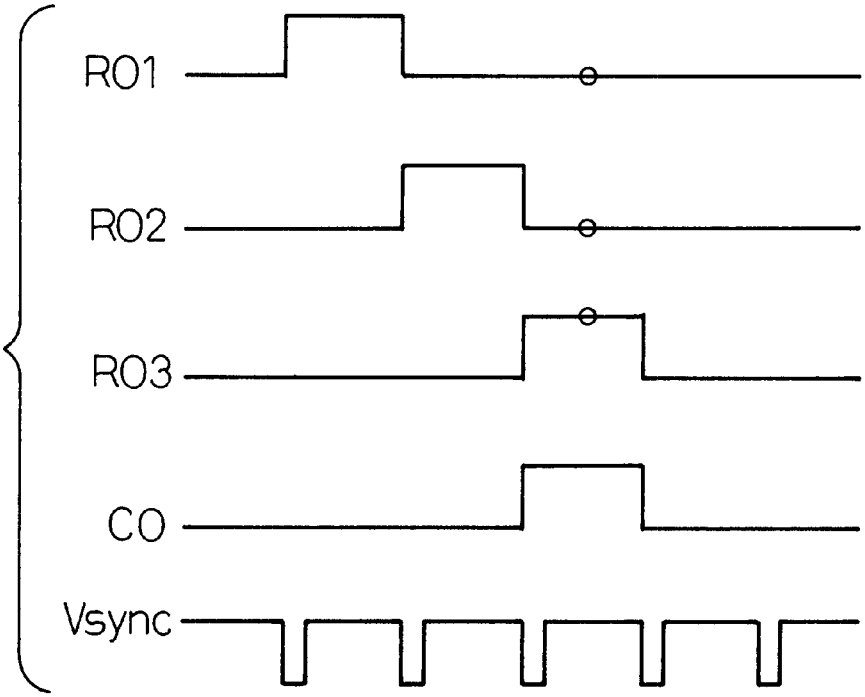
FIG. 22 is a diagram for explaining the variant shown in FIG. 21.

FIG. 21 is a block diagram for explaining a variant of the third embodiment shown in FIG. 20, and FIG. 22 is a diagram for explaining the variant shown in FIG. 21. In FIG. 21, there are shown an address generation circuit 3121, a counter 3122, registers 3123 to 3125, inverters 3126 and 3127, and an AND gate 3128.

As shown in FIG. 21, the comparison image storage memory (frame memory) 311 stores an image of a previous frame (field) via the writing circuit 314. An output of the comparison image storage memory 311 and display data DATA to be displayed actually are compared with each other pixel by pixel. Specifically, an image written in the comparison image storage memory 311 is read according to an output of the address generation circuit 3121 for generating an address signal synchronously with a dot-cycle clock. Each pixel of the image is compared with that of data to be displayed by an EXNOR gate 312. Outputs of the EXNOR gate 312 are counted by the counter 3122. When a count value provided by the counter 3122 exceeds a certain determined value, an overflow signal SOF (of a high level) is output. The EXNOR gate 312 compares pixel by pixel picture data of a previous frame, which is read from the comparison image storage memory 311, with new input picture data (DATA). If the picture data and new picture data disagree with each other, a high-level signal (1) is output. If the picture data and new picture data agree with each other, a low-level signal (0) is output. The counter 3122 is reset with a reset signal (RS) output synchronously with a vertical sync signal.

The overflow signal SOF sent from the counter is supplied to the register 3123 on the initial stage. An output RO1 of the register 3123 is supplied to the register 3124 on the second stage. An output RO2 of the register 3124 is supplied to the register 3125 on the third stage. The output RO1 of the register 3123 on the first stage is supplied to the AND gate 3128 via the inverter 3126. The output RO2 of the register 3124 on the second stage is supplied to the AND gate 3128 via the inverter 3126. The output RO3 of the register 3125 on the third stage is supplied directly to the AND gate 3128. The registers 3123 to 3125 fetch (shift) data synchronously with a vertical sync signal (Vsync).

The AND gate 3128 outputs a signal CO. The signal CO goes high when the outputs RO1 and RO2 of the registers 3123 to 3125 are low and the output RO3 is high. The output CO of the AND gate 3128 is supplied to a reverse signal generation circuit 3129 that outputs a parity signal. The level of the parity signal is reversed every time the output CO of the AND gate 3128 is driven high. In other words, with every input of the output pulse (CO of a high level) of the AND gate 3128, the reverse signal generation circuit 3129 reverses the level of the parity signal (from high to low or from low to high). The parity signal is then output.

When pictures are changed (output RO3 is high) and a new image persists over two or more frames (outputs RO1 and RO2 are low), the parity signal is varied with the output signal CO of the AND gate 3128. By varying the parity signal, a representation by the even display lines is switched to a representation by the odd display lines, or vice versa. The number of registers is not limited to three but may be variable. The condition for switching the display lines to the others is the number of frames (fields) over which the same image persists since pictures were changed. Herein, the condition for switching the display lines to the others can be varied in numerous ways.

Figure 23:
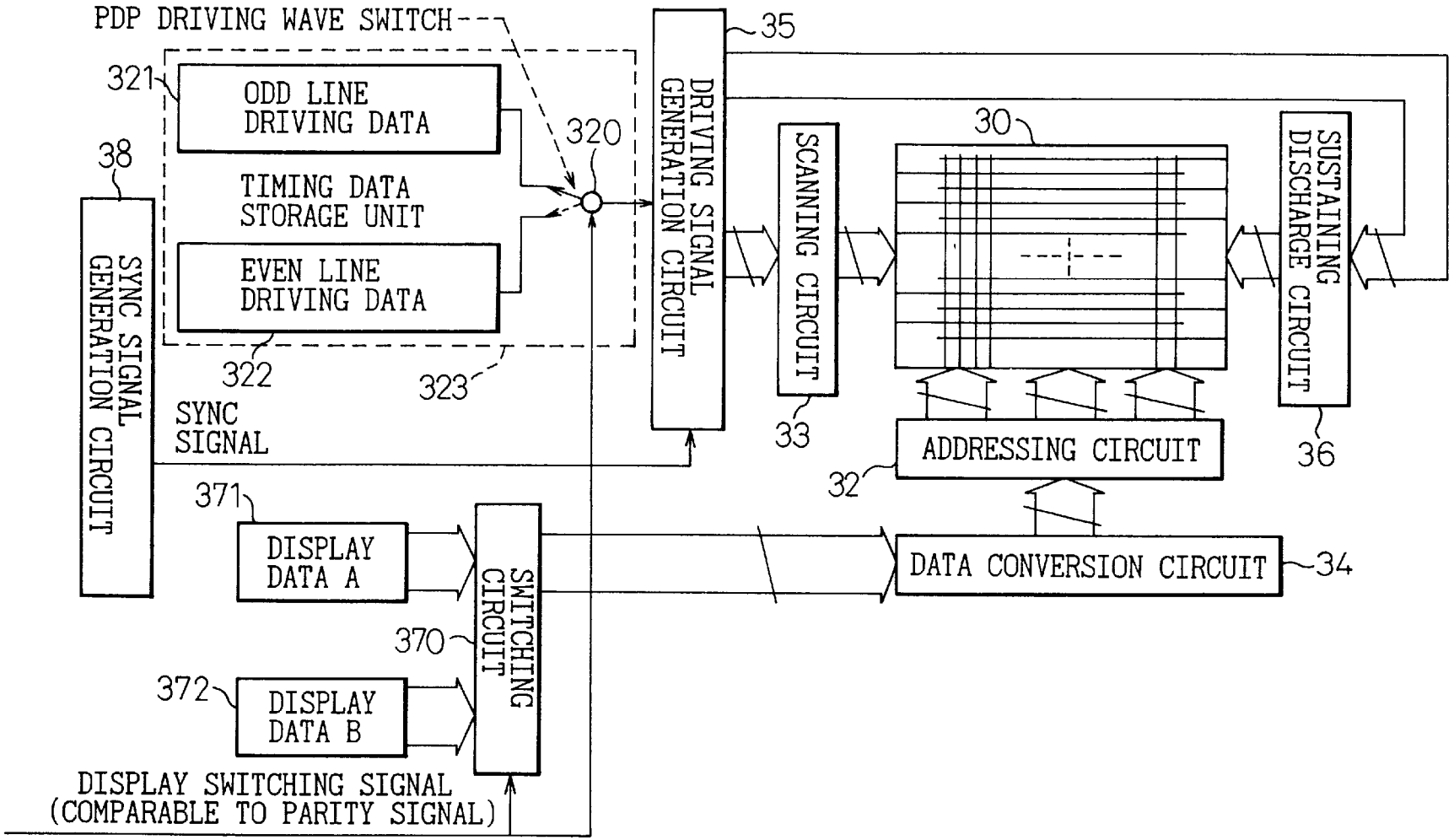
FIG. 23 is a block diagram schematically showing a fourth embodiment of a plasma display device in accordance with the present invention.
Figure 24:
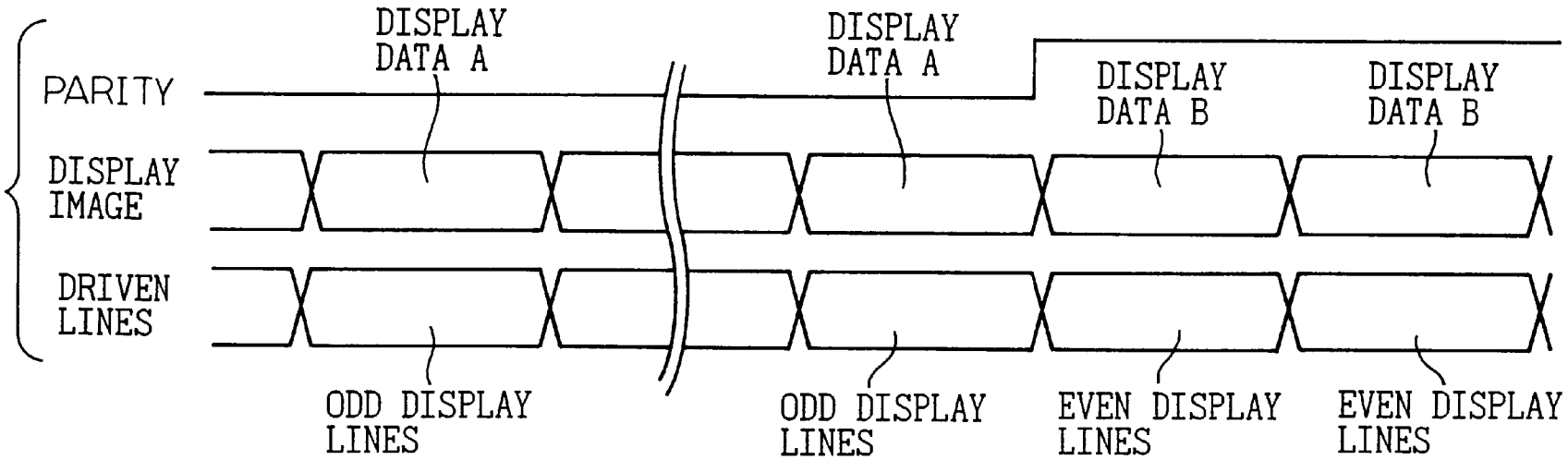
FIG. 24 is a diagram for explaining the actions of the plasma display device shown in FIG. 23.

FIG. 23 is a block diagram schematically showing the fourth embodiment of a plasma display device in accordance with the present invention, and FIG. 24 is a diagram for explaining the actions of the plasma display device shown in FIG. 23.

As shown in FIG. 23, according to the fourth embodiment, when the display lines are switched to the others according to display data, the display data is switched to the other in response to an externally input display switching signal (comparable to the parity signal). As shown in FIG. 24, when the display switching signal (parity signal) is low, the switching circuit 370 selects display data A (371) and supplies it to the data conversion circuit 34. The selector circuit 320 selects the odd line driving data (321), and supplies it to the driving signal generation circuit 35. The display data A is then represented by the odd display lines. Moreover, when the display switching signal (parity signal) is high, the switching circuit 370 selects display data B (372) and supplies it to the data conversion circuit 34. The selector circuit 320 selects the even line driving data (322), and supplies it to the driving signal generation circuit 35. Consequently, the display data B is represented by the even display lines.

According to the fourth embodiment, switching of display data and switching of the display lines are carried out simultaneously. Each display data (for example, display data A or B) is represented by the specified display lines (for example, the odd display lines or even display lines). Thus, sticking of each display data can be made less discernible.

Figure 25:
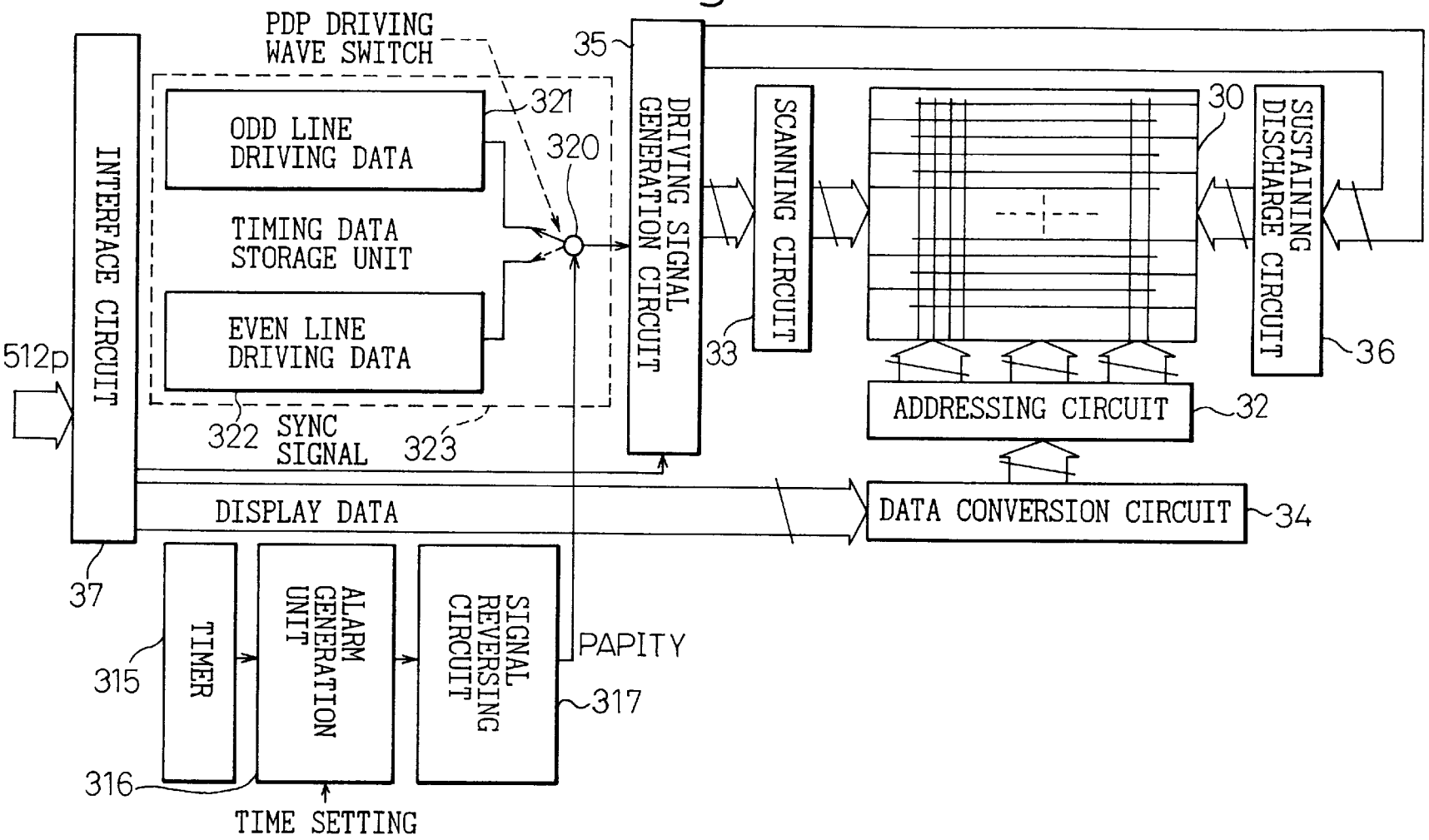
FIG. 25 is a block diagram schematically showing a fifth embodiment of a plasma display device in accordance with the present invention.
Figure 26:
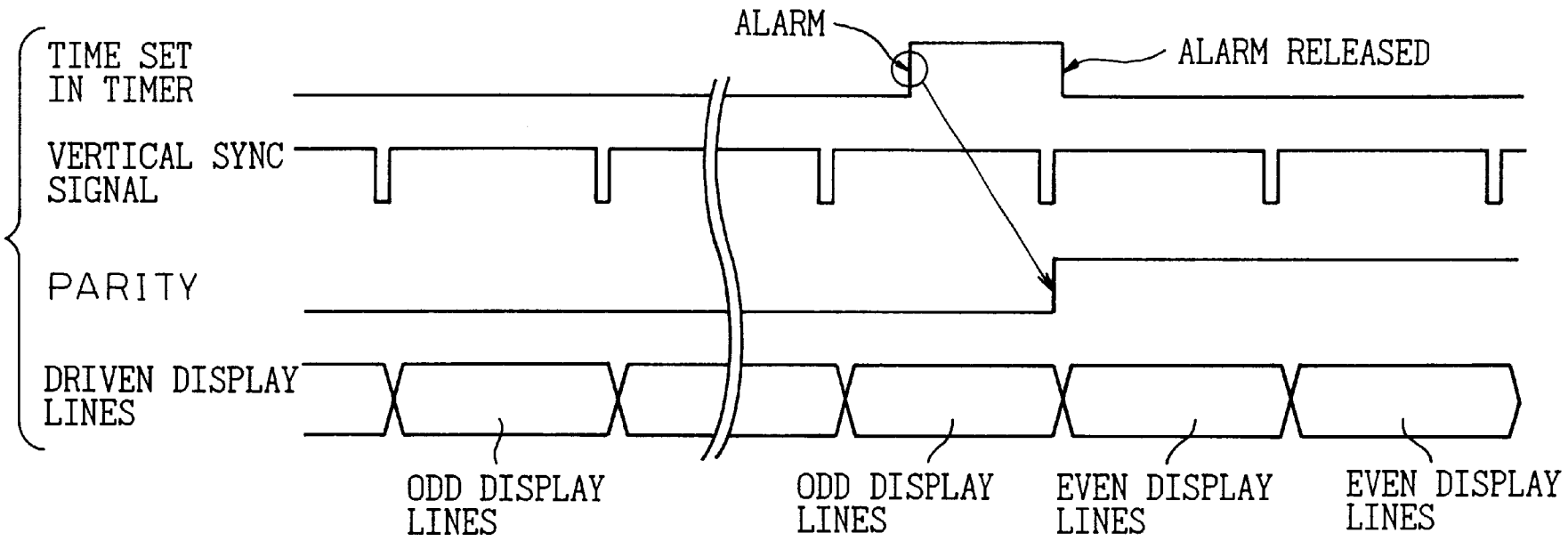
FIG. 26 is a diagram for explaining the actions of the plasma display device shown in FIG. 25.

FIG. 25 is a block diagram schematically showing the fifth embodiment of a plasma display device in accordance with the present invention, and FIG. 26 is a diagram for explaining the actions of the plasma display device shown in FIG. 25. In FIG. 25, there are shown a timer 315, an alarm generation unit 316, and a signal reversing circuit 317.

As shown in FIG. 25, according to the fifth embodiment, an output of the timer 315 is supplied to the alarm generation unit 316. When a predetermined time instant comes, an alarm signal is output to the signal reversing circuit 317. The signal reversing circuit 317 reverses a signal according to a supplied alarm signal. As shown in FIG. 26, a parity signal is reversed from low to high at intervals of a set time in order to switch a representation by the odd display lines into a representation by the even display lines. Otherwise, the parity signal is reversed from high to low at intervals of the set time in order to switch the representation by the even display lines into the representation by the odd display lines. The time set in the alarm generation unit 316 is defined as a time at intervals of which the display lines are lit (allowed to glow) or made unlit for the extended service lives of the phosphorous material and protecting film. The time varies with various factors including the composition and thickness of the actually employed phosphorous material or protecting film. The time is, for example, about one hour but may range from several hours to several days.

As mentioned above, according to the fifth embodiment, a display time during which images are displayed is calculated by integrating the times required by the images. Image display using the even display lines and image display using the odd display lines are switched according to the calculated display time. Assuming that the phosphors lying at the positions of the display lines in the PDP 30 are used continuously for a prolonged period of time, the glowing efficiency of the phosphors deteriorates. According to the fifth embodiment, the deterioration can be suppressed. Moreover, the service lives of the phosphors and protecting film can be extended and sticking in a screen can be prevented. For example, assume that a plasma display device can display 1024 interlaced scanning lines and 512 progressive scanning lines. The plasma display device is used to display an image composed of 512 progressive scanning lines according to the fifth embodiment and to display an image composed of 1024 interlaced scanning lines according to the conventional ALIS driving method. Even in this case, the progress of deterioration of the phosphors will hardly differ between representation display lines and non-representation display lines. This exerts an effect of alleviating a difference in luminance between the even display lines and odd display lines.

Figure 27:
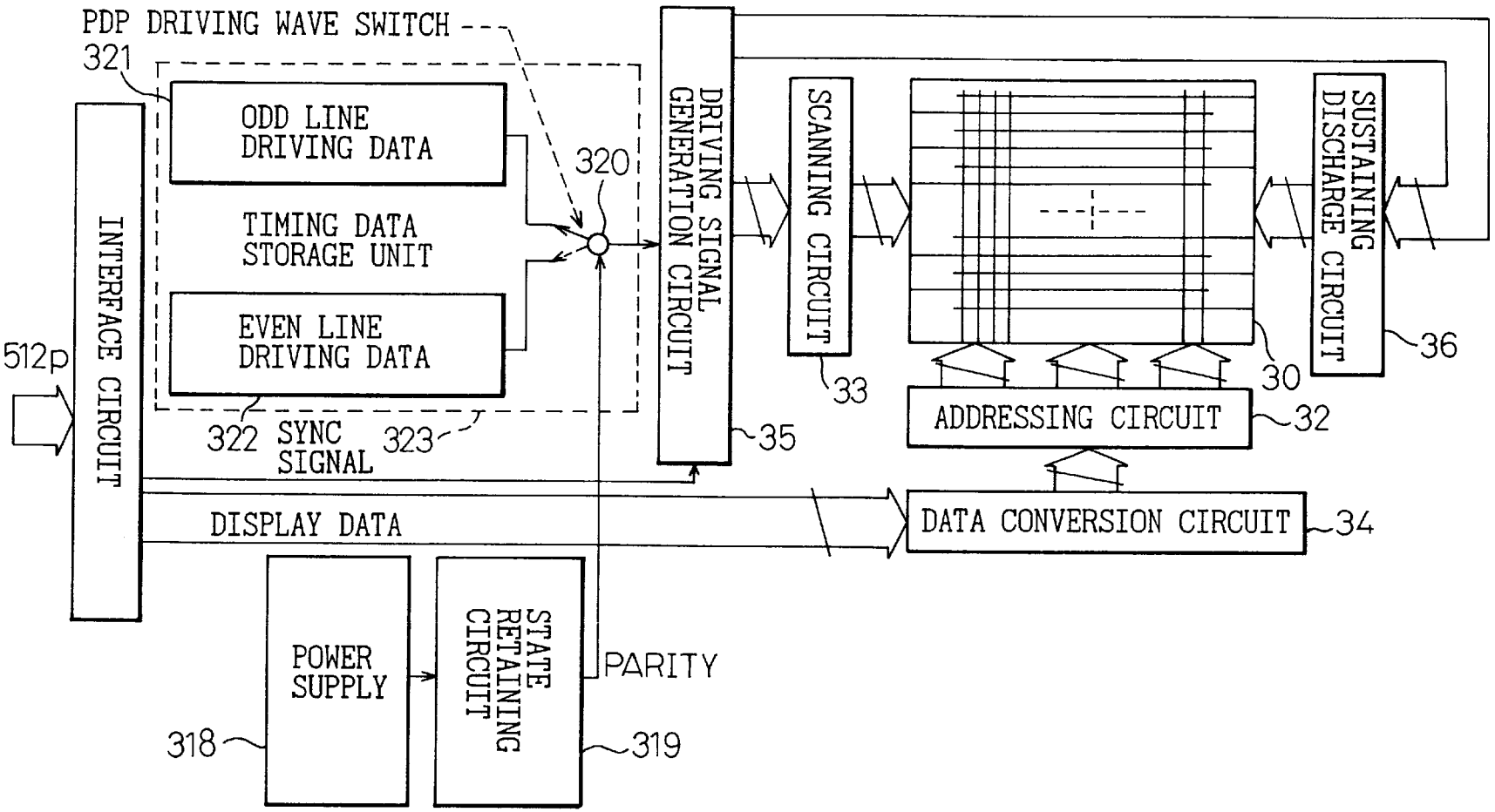
FIG. 27 is a block diagram schematically showing a sixth embodiment of a plasma display device in accordance with the present invention.
Figure 28:
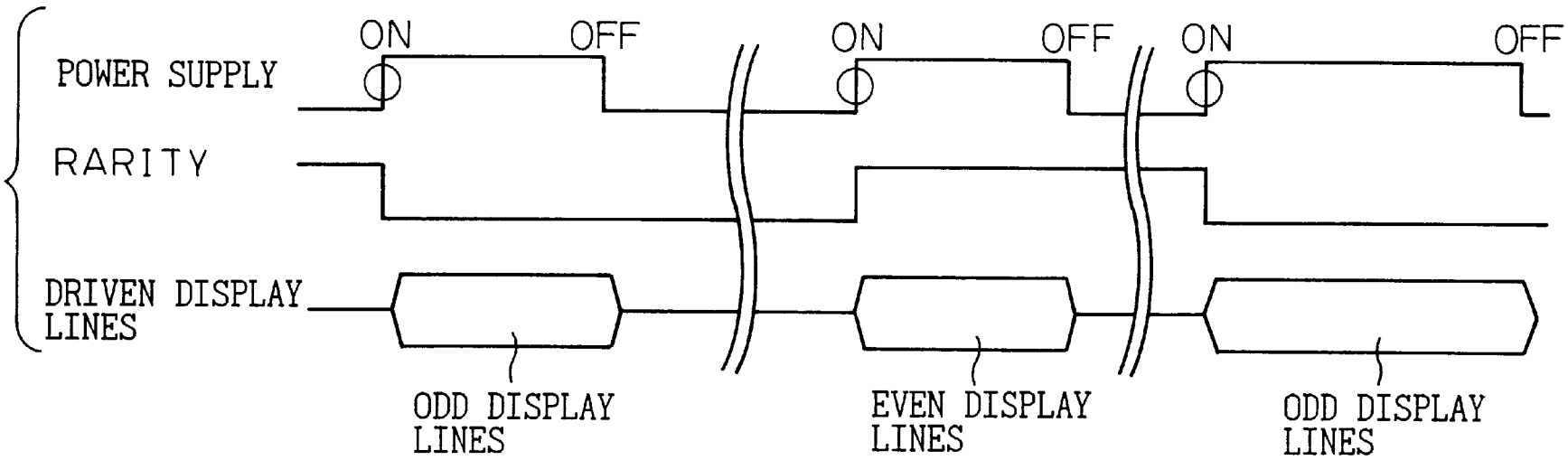
FIG. 28 is a diagram for explaining the actions of the plasma display device shown in FIG. 27.

FIG. 27 is a block diagram schematically showing the sixth embodiment of a plasma display device in accordance with the present invention, and FIG. 28 is a diagram for explaining the actions of the plasma display device shown in FIG. 27.

As shown in FIG. 27, according to the sixth embodiment, display lines are switched to the others every time the power supply of the plasma display device (or an apparatus having the plasma display device mounted thereon) is turned on. A state retaining circuit 319 retains the logic level of a parity signal attained when the power supply is turned off previously during a period during which the plasma display device is not powered. As shown in FIG. 28, when the power supply (318) is turned on, the logic level of the parity signal which is retained by the state retaining circuit 319 is reversed. Display lines other than those used when the power supply is turned off previously are used to display an image according to driving data to be selected by the selector circuit 320. Talking of the display lines other than those used when the power supply is turned off previously, when the power supply is turned off previously, if the odd display lines are used, the display lines are the even display lines. When the power supply is turned off previously, if the even display lines are used, the display lines are the odd display lines.

The sixth embodiment will prove effective in case the power supply of a plasma display device (or an apparatus having the plasma display device mounted thereon) is turned on and off at intervals of about one hour or several hours to several days (every day). Deterioration in the glowing efficiency of the phosphors can be suppressed. In addition, the service lives of the phosphors and protecting film can be extended and sticking in a screen can be prevented. Moreover, a difference in luminance between the even display lines and odd display lines can be alleviated.

Figure 29:
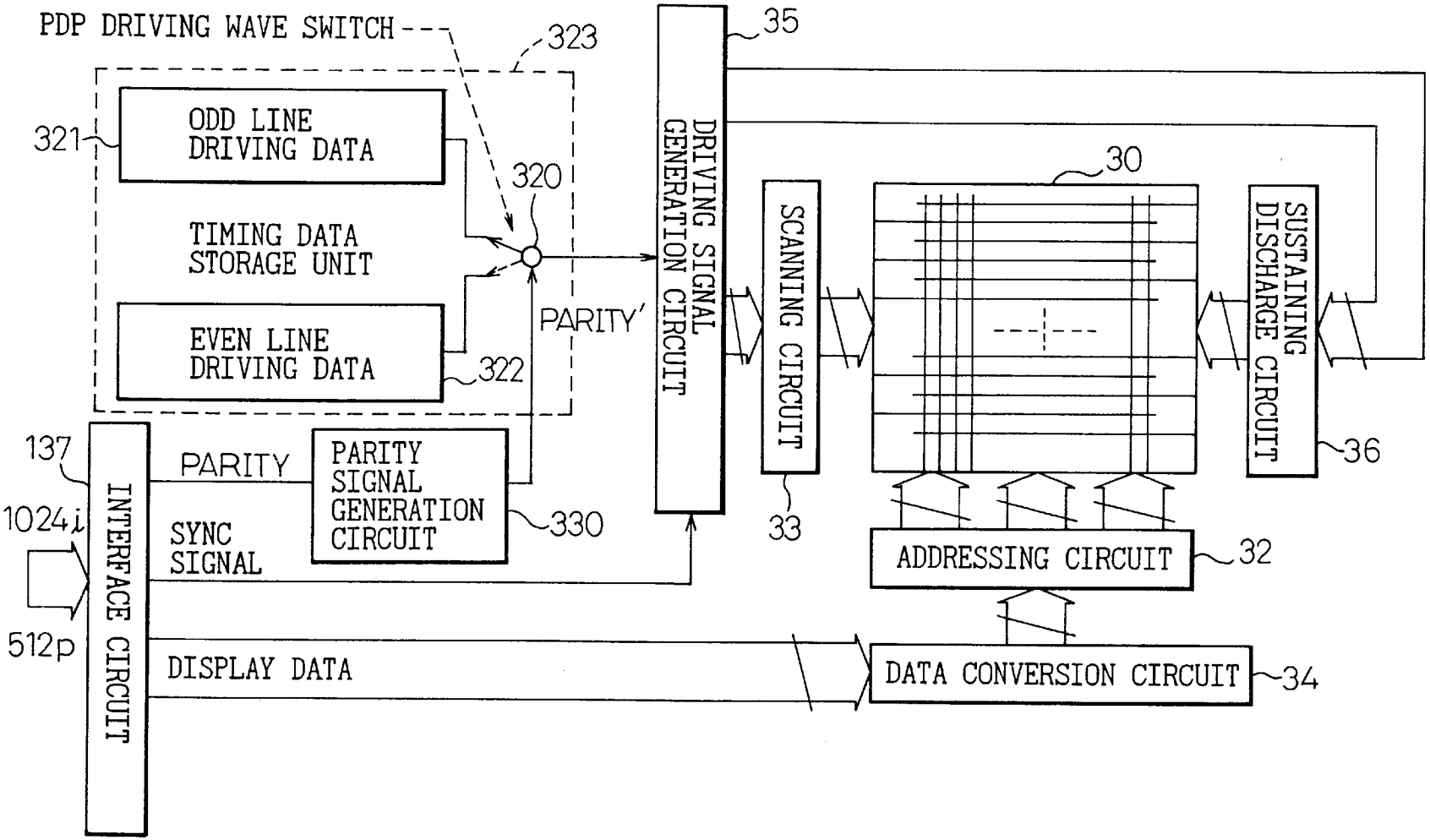
FIG. 29 is a block diagram schematically showing a seventh embodiment of a plasma display device in accordance with the present invention.
Figure 30:
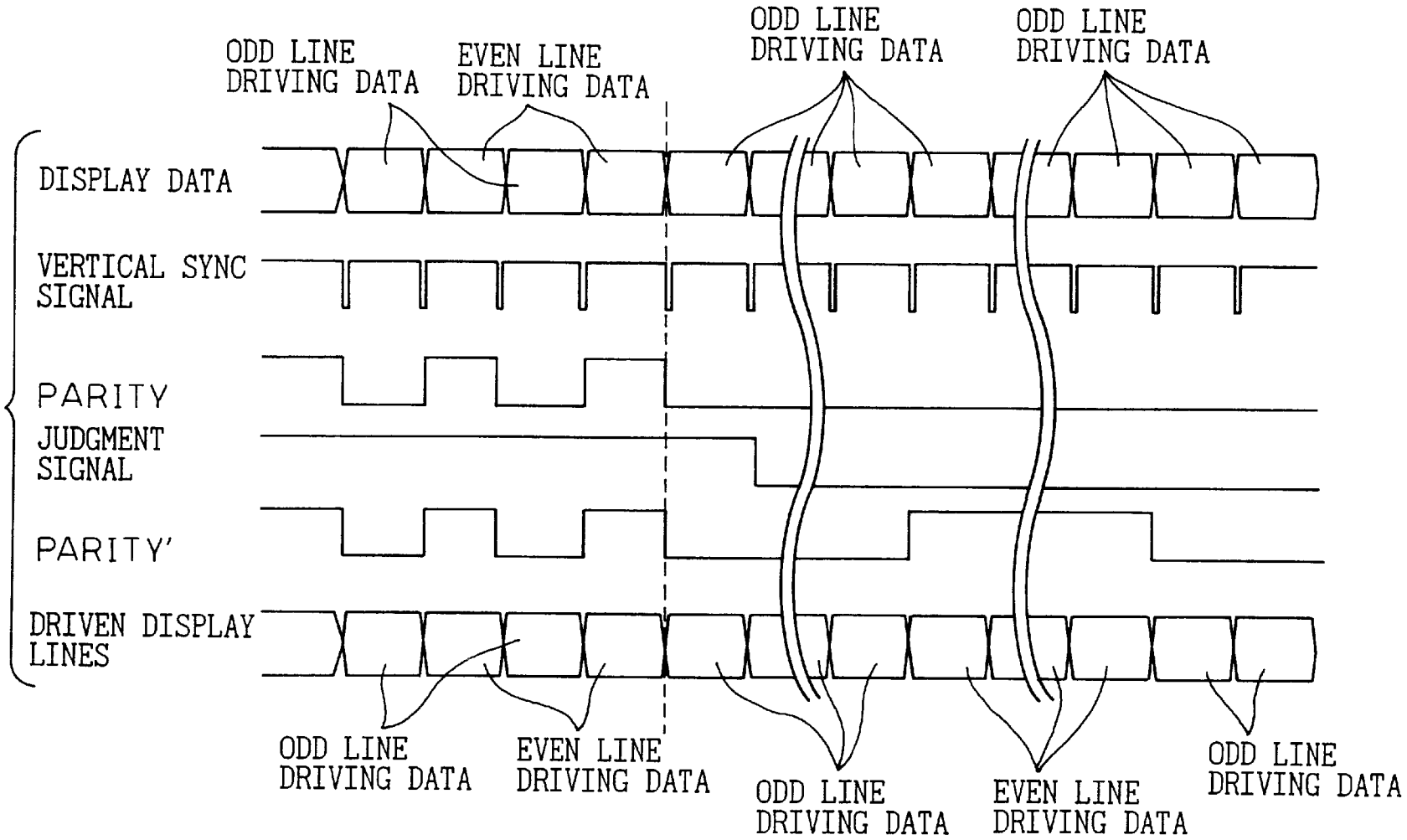
FIG. 30 is a diagram for explaining the actions of the plasma display device shown in FIG. 29.

FIG. 29 is a block diagram schematically showing the seventh embodiment of a plasma display device in accordance with the present invention, and FIG. 30 is a diagram for explaining the actions of the plasma display device shown in FIG. 29. The seventh embodiment has a parity signal generation circuit 330 included in the conventional plasma display device shown in FIG. 11. A parity signal sent via the interface circuit 137 is supplied to the parity signal generation circuit 330. The selector circuit 320 is controlled according to a new parity' signal.

Assume that a video signal representing a picture composed of 1024 interlaced scanning lines is input to the conventional ALIS plasma display device shown in FIG. 11. A parity signal output from the interface circuit 137 is, as shown in FIG. 12, kept reversed at intervals of a field (even field and odd field). Consequently, an image is displayed as a combination of a representation by the even display lines and a representation by the odd display lines. However, when a video signal representing a picture composed of 512 progressive scanning lines is input to the ALIS plasma display device, the parity signal is not reversed. Consequently, either the representation by the even lines or the representation by the odd lines becomes steady.

In the seventh embodiment, when the supplied parity signal does not vary (is not reversed) for a predetermined time (the cycle of a predetermined clock), the parity signal generation circuit 330 causes a judgment signal to vary from high to low. Irrespective of the logic level of the parity signal, a parity' signal is automatically reversed in order to switch display lines to the others. Referring to FIG. 30, a cycle at intervals of which the parity' signal is reversed automatically is a period of three fields. The present invention is not, needless to say, limited to the number of fields. Moreover, three fields construed as a criterion for switching the display lines to the others can be used in combination with the judging circuit (comparison circuit) included in the embodiments.

As mentioned above, the embodiments of the present invention can be adapted to the PDP 10 shown in FIG. 3 or FIG. 11. Once, for example, a driving signal (display data) is processed, the embodiments can also be adapted to the PDP 10P or 10Q (for example, a PDP adopting the interlaced scanning) shown in FIG. 1 or 2. The embodiments can be adapted to a wide range of PDPs capable of independently controlling a representation by the even display lines and a representation by the odd display lines which constitute one frame.

As described so far, according to the present invention, there is provided a plasma display device and a method of driving a plasma display panel. More particularly, an object of the present invention is to provide a plasma display device in which sticking in a screen in which an ordinary image is displayed is less discernible. This is attributable to the fact that a steady image causing sticking and the other ordinary images are distinguished from each other by discriminating a representation by odd lines from a representation by even lines. Furthermore, according to the present invention, there are provided a plasma display device and a method of driving a plasma display panel, wherein the representation by the odd lines and the representation by the even lines are switched. Consequently, the service lives of phosphors and a protecting film can be extended, and sticking in a screen can be prevented.

Many different embodiments of the present invention may be constructed without departing from the spirit and scope of the present invention, and it should be understood that the present invention is not limited to the specific embodiments described in this specification except as defined in the appended claims.

What is claimed is:

1. A plasma display device including a first representing unit for lighting only one of even display lines and odd display lines which represent one frame, and a second representing unit for lighting only the other one of the even display lines and the odd display lines, comprising:

a judging unit for judging a condition for an image to be displayed; and a selector for selecting whichever of said first representing unit and said second representing unit is used to display an image, based on the results of judgment made by said judging unit.

2. A plasma display device as claimed in claim 1, wherein when an image to be displayed is a steady image, said judging unit uses said first representing unit to display the image; and when an image to be displayed is any image other than the steady image, said judging unit uses said second representing unit to display the image.

3. A plasma display device as claimed in claim 2, wherein the steady image is an initial operation image persisting until a predetermined operation is carried out, and images other than the steady image are a plurality of images designated using the initial operation image.

4. A plasma display device as claimed in claim 1, wherein said judging unit includes a display time integrating unit for calculating a display time required by the image to be displayed by integrating time intervals during which the image is displayed, and said judging unit switches an image display using said first representing unit and an image display using said second representing unit, based on the display time required by the image which is calculated by said display time integrating unit.

5. A plasma display device as claimed in claim 1, wherein said judging unit includes an image comparing unit for detecting a change of the image to be displayed to another, and said judging unit switches a first representation and a second representation, according to the detected change of the image.

6. A plasma display device as claimed in claim 5, wherein said comparing unit compares the image to be displayed with an image stored in advance in a comparison image storage unit; when the image to be displayed agrees with the image stored in said comparison image storage unit, said first representing unit is used to represent the image; and when the image to be displayed disagrees with the image stored in said comparison image storage unit, said second representing unit is used to represent the image.

7. A plasma display device as claimed in claim 5, wherein after the image to be displayed is changed to another, if the steady image persists over a predetermined number of frames, said comparing unit switches the first representation and the second representation.

8. A plasma display device as claimed in claim 1, wherein the image display using said first representing unit and the image display using said second representing unit are switched in response to an externally supplied switching signal.

9. A plasma display device as claimed in claim 1, wherein a first image is displayed using both said first representing unit and second representing unit, and a second image is displayed using one of said first representing unit and second representing unit.

10. A plasma display device as claimed in claim 9, wherein the first image is a high-definition television picture, and the second image is an ordinary-definition television picture.

11. A plasma display device as claimed in claim 1, wherein said plasma display device lights one of two display lines lying on and under each scan electrode, and selectively lights only the even display lines or the odd display lines.

12. A plasma display device including a first representing unit for lighting only one of even display lines and odd display lines which represent one frame, and a second representing unit for lighting only the other one of the even display lines and the odd display lines, wherein said first representing unit and said second representing unit represent mutually independent images.

13. A method of driving a plasma display panel that provides a first representation by lighting one of even display lines and odd display lines and a second representation by lighting the other one of the even display lines and the odd display lines, comprising the steps of:

judging a condition for an image to be displayed; and selecting whichever of the first representation and the second representation is used to display an image, based on results of the judgment.

14. A method of driving a plasma display panel as claimed in claim 13, wherein when the image to be displayed is a steady image, the image is displayed using the first representation; and when the image to be displayed is any image other than the steady image, the image is displayed using the second representation.

15. A method of driving a plasma display panel as claimed in claim 14, wherein the steady image is an initial operation image persisting until a predetermined operation is carried out, and the images other than the steady image are a plurality of images to be designated using the initial operation image.

16. A method of driving a plasma display panel as claimed in claim 13, wherein a display time required by the image to be displayed is calculated by integrating time intervals during which the image to be displayed is displayed, and the first representation and the second representation are switched, based on the calculated display time.

17. A method of driving a plasma display panel as claimed in claim 13, wherein a change of the image to be displayed to another is detected, and said first representation and second representation are switched based on the detected change of the image to be displayed.

18. A method of driving a plasma display panel as claimed in claim 17, wherein the image to be displayed is compared with an image stored in advance in a comparison image storage unit; when the image to be displayed agrees with the image stored in said comparison image storage unit, the image is displayed using said first representation; and when the image to be displayed disagrees with the image stored in said comparison image storage unit, the image is displayed using the second representation.

19. A method of driving a plasma display panel as claimed in claim 17, wherein after the image to be displayed is changed to another, when a steady image persists over a predetermined number of frames, the first representation and the second representation are switched.

20. A method of driving a plasma display panel as claimed in claim 13, wherein the first representation and the second representation are switched in response to an externally supplied switching signal.

21. A method of driving a plasma display panel as claimed in claim 13, wherein a first image is displayed using both of the first representation and the second representation, and a second image is displayed using one of the first representation and the second representation.

22. A method of driving a plasma display panel as claimed in claim 21, wherein the first image is a high-definition television picture and the second image is an ordinary-definition television picture.

23. A method of driving a plasma display panel as claimed in claim 13, wherein said plasma display panel lights one or the other of two display lines lying on and under each scan electrode, and selectively lights only the even display lines or the odd display lines.

24. A method of driving a plasma display panel that provides a first representation by lighting one of even display lines and odd display lines that represent one frame, and a second representation by lighting the other one of the even display lines and the odd display lines, wherein the first representation and the second representation are used to display mutually independent images.

* * * * *